US007937026B2

(12) United States Patent
Nagami et al.

(10) Patent No.: US 7,937,026 B2
(45) Date of Patent: May 3, 2011

(54) LIQUID DEVELOPING ELECTROPHOTOGRAPHIC DEVICE ROLLER AND LIQUID DEVELOPING ELECTROPHOTOGRAPHIC DEVICE

(75) Inventors: Harushi Nagami, Kobe (JP); Hiroshi Sanda, Kobe (JP); Takayuki Nagase, Kobe (JP); Sadaharu Nakamura, Kobe (JP)

(73) Assignee: Bando Chemical Industries, Ltd., Hyogo (JP)

( * ) Notice: Subject to any disclaimer, the term of this patent is extended or adjusted under 35 U.S.C. 154(b) by 191 days.

(21) Appl. No.: 12/306,365

(22) PCT Filed: Jun. 19, 2007

(86) PCT No.: PCT/JP2007/062306

§ 371 (c)(1), (2), (4) Date: Dec. 23, 2008

(87) PCT Pub. No.: WO2008/001646

PCT Pub. Date: Jan. 3, 2008

(65) Prior Publication Data

US 2009/0290909 A1 Nov. 26, 2009

(30) Foreign Application Priority Data

| | | |
|---|---|---|
| Jun. 27, 2006 | (JP) | 2006-176792 |
| Jun. 27, 2006 | (JP) | 2006-176939 |
| Jun. 27, 2006 | (JP) | 2006-176950 |
| Jun. 27, 2006 | (JP) | 2006-176964 |
| Apr. 10, 2007 | (JP) | 2007-102797 |
| Apr. 20, 2007 | (JP) | 2007-111685 |

(51) Int. Cl.
*G03G 15/10* (2006.01)

(52) U.S. Cl. ..... 399/239

(58) Field of Classification Search ..... 399/237, 399/239, 348, 349
See application file for complete search history.

(56) References Cited

U.S. PATENT DOCUMENTS

| | | | | |
|---|---|---|---|---|
| 4,974,030 | A * | 11/1990 | Tokunaga et al. | 399/349 X |
| 5,043,410 | A | 8/1991 | Re et al. | |
| 5,053,316 | A * | 10/1991 | Suzuki et al. | 430/281.1 |
| 5,500,724 | A | 3/1996 | Campbell et al. | |
| 2004/0166790 | A1 * | 8/2004 | Balijepalli et al. | 451/526 |

FOREIGN PATENT DOCUMENTS

| | | | |
|---|---|---|---|
| JP | 62269973 | A | 11/1987 |
| JP | 02180917 | A | 7/1990 |
| JP | 08050436 | A | 2/1996 |
| JP | 09269629 | A | 10/1997 |
| JP | 10087775 | A | 4/1998 |
| JP | 2001-194912 | A | 7/2001 |
| JP | 2003057913 | A | 2/2003 |
| JP | 2003098833 | A | 4/2003 |
| JP | 2004258260 | A | 9/2004 |
| JP | 2005070181 | A | 3/2005 |
| JP | 2005242289 | A | 9/2005 |

* cited by examiner

*Primary Examiner* — Sandra L Brase
(74) *Attorney, Agent, or Firm* — The Webb Law Firm

(57) ABSTRACT

An object of the present invention is to provide a liquid developing electrographic device roller suppressed in volumetric variation caused by a carrier. As a means for solving the problems, the present invention provides a liquid developing electrophotographic device roller including a shaft and an elastic material layer provided around the outer peripheral side of the shaft, wherein the elastic material layer is formed by using a polyurethane obtained by reacting a polyester polyol with a difunctional isocyanate.

19 Claims, 2 Drawing Sheets

LIQUID DEVELOPING ELECTROPHOTOGRAPHIC DEVICE ROLLER AND LIQUID DEVELOPING ELECTROPHOTOGRAPHIC DEVICE

TECHNICAL FIELD

The present invention relates to a liquid developing electrophotographic device roller and a liquid developing electrophotographic device and, particularly, to a liquid developing electrophotographic device roller with an elastic material layer formed thereon and a liquid developing electrophotographic device.

BACKGROUND ART

Electrophotographic devices are conventionally used widely in which an electrostatic latent image drawn on a photoreceptor by a laser or the like is visualized by a toner or the like and is then transferred to the surface of paper or the like to put into print. In recent years, this toner particle is micronized to improve printing accuracy, and liquid developers (hereinafter also referred to as "liquid toner") have come to be used which are obtained by dispersing toner particles micronized to, for example, about 1 μm in a liquid called a carrier constituted of such as liquid paraffin, silicon oil, mineral oil or vegetable oil. Consequently, liquid developing electrophotographic devices (see, Patent References 1 and 2 described below) using such a liquid toner have come to be used.

In this liquid developing electrophotographic device, various rollers such as a developing roller, transfer roller, squeeze roller and abrasive roller are used. These various rollers are usually formed by providing an elastic material layer using an elastic material such as a rubber or a resin having a low hardness around the outer periphery of a shaft such as a core bar.

However, such a roller is used in a circumstance where it is in direct contact with the carrier mentioned above and is exposed to vaporized carrier in this liquid developing electrophotographic device.

Therefore, there is such a problem that, for example, the rubber or resin used for forming the elastic material layer of the roller is, for example, swollen in the carrier, causing a variation in the volume of the elastic material layer.

When the elastic material layer of this liquid developing electrophotographic device roller is varied in volume, the contact pressure, nip width and the like between these rollers are varied, resulting in low printing accuracy.

For this reason, for the liquid developing electrophotographic device, a roller having suppressed in volumetric variation caused by a carrier is required. However, the conventional liquid developing electrophotographic device roller is only insufficiently suppressed in volumetric variation caused by a carrier and does not reach the level at which the aforesaid requirements are satisfied.

Specifically, the conventional liquid developing electrophotographic device is insufficiently suppressed in a deterioration of printing accuracy accompanied with a variation in the volume of the liquid developing electrophotographic device roller.

Patent Reference 1: Japanese Unexamined Patent Publication No. 2003-057913

Patent Reference 2: Japanese Unexamined Patent Publication No. 2005-070181

DISCLOSURE OF THE INVENTION

Problems to be Solved by the Invention

It is an object of the present invention to provide a liquid developing electrophotographic device roller having suppressed in volumetric variation caused by a carrier and a liquid developing device photographic device superior in printing accuracy.

Means for Solving the Problems

The present inventors have found that when the elastic material layer of the liquid developing electrophotographic device roller is formed of a specified polyurethane, this elastic material layer can be suppressed in volumetric variation caused by a carrier and then have achieved the present invention.

Specifically, in order to solve the aforesaid problem, a liquid developing electrophotographic device roller including a shaft and an elastic material layer provided around the outer peripheral side of the shaft, wherein the elastic material layer is formed by using a polyurethane obtained by reacting a polyester polyol with a difunctional isocyanate.

EFFECT OF THE INVENTION

A polyurethane obtained by reacting a polyester polyol with a difunctional isocyanate is resistant to swelling with materials, such as liquid paraffin, silicon oil, mineral oil or vegetable oil, which are usually used as the carrier and is therefore resistant to volumetric variation.

Specifically, the present invention can provide a liquid developing electrophotographic device roller having suppressed in volumetric variation caused by the carrier.

Then, the use of such a liquid developing electrophotographic device roller can suppress a deterioration in printing accuracy accompanied with volumetric variation.

In other words, the use of the liquid developing electrophotographic device roller can provide a liquid developing electrophotographic device having high printing accuracy.

EXPLANATIONS OF THE REFERENCE NUMERALS

1: Photoreceptor, 2: Intermediate transfer roller, 3: Pressure roller, 4: Toner draw roller (Anirox roller), 5: Running-in roller, 6: Developing roller, **6*a*: Core bar, 6*b*: Base material layer, 6*s*: Surface layer, 7: Flocculating roller, 8: Squeeze roller, 9: Abrasive roller, 10, 10'**: Cleaning blade, A: Print product, X: Liquid toner reserving section, Y: Liquid toner

BEST MODE FOR CARRYING OUT THE INVENTION

Preferred embodiments of the present invention will be described below (with reference to the appended drawings).

First, a liquid developing electrophotographic device using a liquid developing electrophotographic device roller according to this embodiment will be described with reference to FIG. 1.

Figure 1:
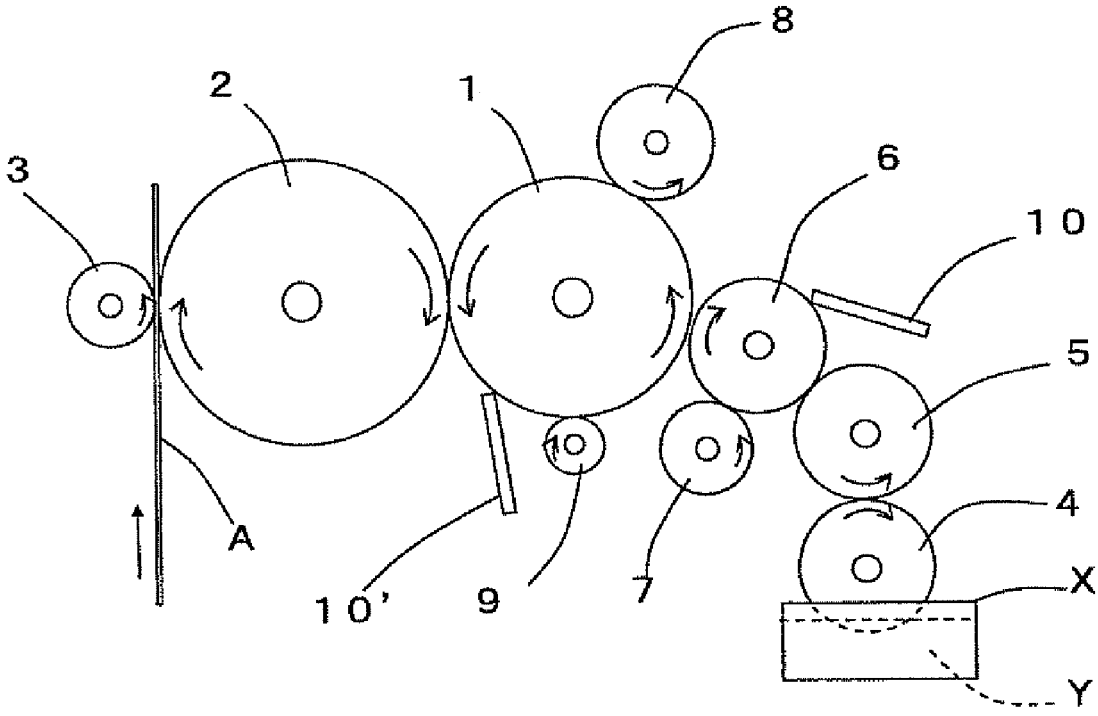
FIG. 1 is a schematic side view showing the structure of a liquid developing electrophotographic device.

FIG. 1 is a schematic side view showing the main structure (printing mechanism) of the liquid developing electrophotographic device using the liquid developing electrophotographic device roller of this embodiment. In this liquid developing electrophotographic device, a photoreceptor and various rollers are used.

More specifically, this liquid developing electrophotographic device uses a photoreceptor 1 which is formed into a cylindrical shape and is rotated around the center axis thereof to form a latent image successively on the outer peripheral surface thereof by using a liquid toner, and an intermediate transfer roller 2 which primarily transfers the latent image formed on the photoreceptor 1 by bringing its outer peripheral surface into contact with the photoreceptor 1 to secondarily transfer the latent image to a print product A such as paper.

Also, the liquid developing electrophotographic device is provided with a pressure roller 3 which is disposed in such a manner that its peripheral surface is brought into contact with the aforesaid intermediate transfer roller 2, and is rotated together with the intermediate transfer roller 2 in the condition that the print product A is introduced between the pressure roller 3 and the intermediate transfer roller 2, to convey the print product A in the direction of the rotation (the direction of the movement of the surface) of the intermediate transfer roller 2 while pressing the print product A against the intermediate transfer roller 2, thereby secondarily transferring the latent image primarily transferred to the intermediate transfer roller 2 to this print product A.

Also, the liquid developing electrophotographic device is provided with, for example, a toner drawing roller 4 (hereinafter referred to as "Anirox roller") that rotates in such a manner that its outer peripheral surface is brought into contact with a liquid toner Y contained in a liquid toner reserving section X to thereby form a liquid film of the liquid toner Y, thereby drawing the liquid toner Y on its outer peripheral surface, a running-in roller 5 that is disposed in such a manner that its peripheral surface is brought into contact with the toner drawing roller 4 to take the liquid toner stuck to the outer peripheral surface of the drawing roller 4 in the smoothed condition on its outer peripheral surface, and a developing roller 6 that is disposed in such a manner that its peripheral surface is brought into contact with the running-in roller 5 to take the liquid toner stuck to the outer peripheral surface of the running-in roller 5, thereby supplying the liquid toner to the photoreceptor 1.

Furthermore, the liquid developing electrophotographic device is provided with a flocculating roller 7 that applies bias voltage to the developing roller 6 and also gives a charge to the developing roller 6 to divide the liquid toner supplied from the running-in roller 5 into a carrier layer and a toner flocculation layer on the developing roller 6, a squeeze roller 8 that squeezes the carrier of the liquid toner supplied to the photoreceptor 1 from the developing roller 6 and an abrasive roller 9 that is in contact with the photoreceptor 1 to finely abrade the surface of the photoreceptor 1 thereby keeping the surface of the photoreceptor 1 clean.

Also, the liquid developing electrophotographic device is provided with a cleaning blade 10 that cleans the surface of the developing roller 6 and a cleaning blade 10' that cleans the surface of the photoreceptor.

Next, the liquid developing electrophotographic device roller in this embodiment will be described taking the aforesaid developing roller 6 as a first example.

The developing roller in this embodiment is provided with an elastic material layer made of an elastic material that is disposed on the outer periphery of a core bar.

This elastic material layer is formed of a polyurethane obtained by reacting a polyester polyol with a difunctional isocyanate. This elastic material layer is formed of a polyurethane formulated with carbon black such that the volume resistance of the elastic body layer becomes $10^2$ to $10^6$ Ω·cm.

When the elastic material layer is formed in such a manner that the volume resistance of the elastic body layer is $10^2$ to $10^6$ Ω·cm, this roller can be made to have conductivity suitable for the developing roller in the liquid developing electrophotographic device.

Also, the aforesaid elastic material layer is formed so as to have a JIS-A hardness of 30 to 60 degrees by using the aforesaid polyurethane.

The reason why this elastic material layer is formed so as to have a JIS-A hardness of 30 to 60 degrees is that when this hardness is less than 30 degrees, the elastic material layer is too soft and it is therefore difficult to adjust the smoothness of the surface by, for example, cutting process or the like whereas when this hardness exceeds 60 degrees, the elastic material layer is too hard and it is therefore difficult to exhibit satisfactory developing ability.

Therefore, the formation of the elastic body layer having a JIS-A hardness of 30 to 60 degrees enables the production of a developing roller which has surface smoothness suitable for the developing roller and also good developing ability.

Here, this JIS-A hardness means the Type A Duro-meter Hardness (instantaneous value) prescribed in JIS K 6253 which is measured in normal condition.

The reason why a polyester polyol is used for this polyurethane is that when other polyols are used, the elastic material layer is easily swollen with a material, such as liquid paraffin, silicon oil, mineral oil or vegetable oil, which is usually used as the carrier and therefore, the volumetric variation of the developing roller exceeds, for example, 10%, leading to a reduction in the printing accuracy of the liquid developing electrophotographic device.

As this polyester polyol, it is preferable to use a polyester polyol obtained by reacting adipic acid with a difunctional glycol and trimethylolpropane, though there is no particular limitation.

The reason why it is preferable to use adipic acid as the raw material component of this polyester polyol is that when adipic acid is used, the volumetric variation of the elastic material layer caused by the carrier can be made smaller and a reduction in the printing accuracy of the liquid developing electrophotographic device can be more highly suppressed than when other dicarboxylic acids such as sebacic acid are used.

Also, as the difunctional glycol, those having 2 to 6 carbon atoms are preferable and any one of diethylene glycol, 1,4-butanediol and 3-methylpentanediol(3-methyl-1,5-pentanediol) is preferable.

In the case where as this difunctional glycol, those having 2 to 6 carbon atoms, and particularly, any one of diethylene glycol, 1,4-butanediol and 3-methylpentanediol is used, the volumetric variation of the elastic material layer caused by the carrier can be made to be small, so that a reduction in the printing accuracy of the liquid developing electrophotographic device can be suppressed.

Among them, when the difunctional glycol is one having a hydrophobic group such as 3-methylpentanediol, an elastic material layer which is scarcely affected by temperature and humidity can be formed.

Specifically, a dimensional variation in a low-temperature and low-humidity condition or a high-temperature and high-humidity condition is suppressed, and it is therefore possible to suppress a variation in printing accuracy because of the surrounding circumstance of the liquid developing electrophotographic device or the like, being capable of performing uniform printing operations.

The polyester polyol obtained by containing such raw material components has a number average molecular weight of preferably 500 to 3000 and more preferably 1000 to 3000, though there is no particular limitation.

The reason why the number average molecular weight of the polyester polyol is preferably in the aforesaid range is that there is a fear that a polyester polyol having a number average molecular weight exceeding 3000 deteriorates workability in, for example, an injection molding step because the viscosity is too high, whereas a polyester polyol having a number average molecular weight less than 500 makes it difficult to obtain a cured product having a low hardness.

Here, this number average molecular weight can be measured by gel permeation chromatograph (GPC), and can be measured, for example, using GPC (model: "HLC-8020", manufactured by Tosoh Corporation) by combining three columns, "G-4000", "G-3000" and "G-2000" (all manufactured by Tosoh Corporation) and by using chloroform as the moving phase.

Also, the average number of functional groups of the polyester polyol obtained by containing such raw material components is preferably 3.0 or more.

When a polyester polyol having an average number of functional groups of 3.0 or more is used, an elastic material layer having a small compression set can be formed. An elastic material layer having a compression set less than 1% can be formed in the condition of, for example, 70° C.×22 Hr.

Furthermore, the chemical crosslinks are increased and apparent physical crosslinks are reduced and the water absorbing property (reduction in water absorption) can be improved by increasing the average number of functional groups.

Also, the polyester polyol obtained by containing such raw material components preferably has an acid value range from 0.2 to 1.0.

The water absorbing property (reduction in water absorption) can be improved and the dimensional variation of the elastic material layer caused by temperature and humidity can be therefore suppressed by reducing the acid value.

As the aforesaid difunctional isocyanate, any one of tolylenediisocyanate (TDI), xylenediisocyanate (XDI) and diphenylmethanediisocyanate (MDI) is preferably used and particularly any one of tolylenediisocyanate and xylenediisocyanate is preferable, though there is no particular limitation.

The use of tolylenediisocyanate or xylenediisocyanate as this difunctional isocyanate ensures that the volumetric variation of the elastic material layer caused by a carrier can be reduced, which furthermore suppresses a deterioration in the printing accuracy of the liquid developing electrophotographic device.

Additionally, when tolylenediisocyanate or xylenediisocyanate is used, a curing reaction with the aforesaid polyester polyol can be performed at a higher reaction rate than when, for example, diphenylmethanediisocyanate is used. Therefore, when tolylenediisocyanate or xylenediisocyanate is used, the developing roller can be designed to be an efficiently producible one.

The amounts of these polyester polyol and difunctional glycol to be formulated can be properly adjusted and they may be formulated in the amounts enough to put the product to be put into the curing condition substantially usable as the developing roller. The volumetric variation of the elastic material layer caused by the carrier can be reduced by formulating, for example, a polyester polyol obtained by the reaction of adipic acid with a difunctional glycol and trimethylolpropane, and tolylenediisocyanate or xylenediisocyanate to form the elastic material layer in such a manner that the JIS-A hardness of the elastic material layer is 30 to 60 degrees after the layer is cured.

Also, carbon black to be formulated in this polyurethane is not particularly limited and carbon black generally called such as furnace black, channel black or thermal black including highly electroconductive carbon black generally called acetylene black besides "KETCHEN BLACK" commercially available from Ketchen Black International Company and "VULCAN" manufactured by Cabot Corporation may be used.

Furthermore, as the shaft used to form the elastic material layer by using a polyurethane formulated with this carbon black, a conductive bar-like material, and specifically, a core bar made of a hollow or solid metal bar-like material having a circular section may be used.

As the core bar, materials made of, for example, a metal such as copper, iron, aluminum or nickel and its alloy or those obtained by plating with these metals or alloys by means of melt plating, electroplating or electroless plating may be used.

Also, the developing roller may be further provided with a surface layer on the outer peripheral side of the elastic material layer as will be described in detail later. Furthermore, other layers may be formed between the elastic material layer and the shaft (core bar).

Specifically, the elastic material layer may be provided around the outer peripheral side of the core bar through other layers interposed therebetween and a surface layer may be further provided on the outer peripheral side of this elastic material layer, or the elastic material layer may also be provided around the outer peripheral side of the core bar in the condition that the elastic material layer is brought into directly contact with the core bar and a surface layer may be formed on the outer peripheral side of the elastic material layer.

In the developing roller, in particular, the surface layer is preferably formed using a polyurethane solution obtained by dissolving a thermoplastic polyurethane in a solvent and by further dispersing carbon black in the solution.

This thermoplastic polyurethane is preferable in that it has excellent adhesion and scratching resistance to the elastic material layer described as above, has high strength against the member to be brought into contact with the surface of the developing roller and also has high flexibility, so that it has excellent follow-up property for the deformation of the roller or the like and is therefore resistant to the occurrences of wrinkles and peeling. Among them, a thermoplastic polyester based polyurethane or polyether based thermoplastic polyurethane is preferably used.

Also, as the solvent for dissolving this thermoplastic polyurethane, tetrahydrofuran, methyl ethyl ketone, toluene or isopropyl alcohol or a mixed solvent thereof may be used and it is preferable to use a mixed solvent prepared by further mixing cyclohexane or dimethylformamide in the aforesaid solvent to adjust the drying speed of the polyurethane solution.

As the carbon black, high conductive carbon black generally called acetylene black besides "KETCHEN BLACK"

commercially available from Ketchen Black International Company and "VULCAN" manufactured by Cabot Corporation is also preferable.

As a method for producing the developing roller having such a material and structure, the methods used in general to produce the polyurethane roller may be used. For example, after the polyurethane elastic material is provided around the core bar by using such as a metal mold, the surface of the elastic material layer may be abraded to be adjusted to a given surface smoothness, thereby forming a surface layer. Also, to form the surface layer, a method may be used in which a surface layer-forming polyurethane solution as mentioned above is applied directly to the surface of this elastic material layer by dip coating or the like and then heat-treated.

As the polyurethane solution, at this time, a solution obtained by dissolving 3 to 20% by weight of the thermoplastic polyurethane as mentioned above and 10% by weight or less of carbon black as mentioned above in a solvent such as those mentioned above is used. This solution is resistant to the occurrences of cissing and unevenness on the aforesaid polyurethane elastic material layer, and therefore, it is easy to keep the uniformity of the thickness of the layer and the dispersion of carbon is easily maintained in a good state. Also, the heat treating temperature at this time is set to, for example, 80 to 120° C., thereby making it possible to restrain the possibility that the polyurethane elastic material layer is deteriorated by heating and to form a good surface layer.

Furthermore, the surface of this surface layer (or the surface of other liquid developing electrophotographic device roller in which the elastic material layer is used in an exposed state) is preferably formed so as to have a surface roughness of 3 μm or less in terms of ten point height of roughness profile (Rz) prescribed in JIS B 0601.

Figure 2:
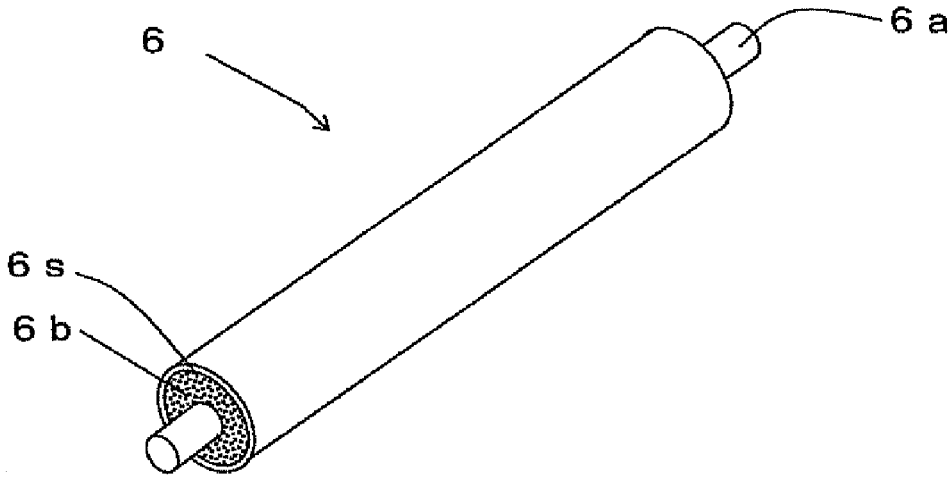
FIG. 2 is a schematic perspective view showing a liquid developing electrophotographic device roller (developing roller).

Then, the developing roller is described which is provided with the surface layer described in the first embodiment as a second embodiment of the liquid developing electrophotographic device roller with reference to FIG. 2.

The developing roller 6 illustrated in FIG. 2 is provided with a core bar 6*a* which is to be the shaft at the center thereof and a surface layer 6*s* constituting the outer peripheral surface which is in contact with a liquid toner.

Also, a base material layer 6*b* is provided between the core bar 6*a* and surface layer 6*s* of the developing roller 6. This base material layer 6*b* includes an elastic material layer formed by using the polyurethane that is the same as one in the first embodiment and in the developing roller 6 illustrated in FIG. 2, the base material layer 6*b* is constituted only of an elastic material layer.

Also, like the developing roller described in the first embodiment, the developing roller 6 may be provided with the base material layer 6*b* containing en elastic material layer and other layers by providing the elastic material layer around the outer peripheral surface of the core bar through these other layers interposed therebetween in place of the case where the base material layer 6*b* is constituted only of the elastic material layer.

The aforesaid surface layer may be formed of a resin composition obtained by the reaction between a base resin and a fluorine modifier prepared by using a fluorine based resin having a structure in which a part of a block copolymer containing a perfluoroalkyl block and other blocks is substituted with a reactive functional group.

This base resin of the surface layer is preferably, though it is not particularly limited to, an acryl resin or a thermoplastic polyurethane and particularly, this thermoplastic polyurethane is preferable in that, it has excellent adhesion and scratching resistance to the elastic material layer described as above and resistance to the carrier, and also has high flexibility, so that it has excellent follow-up property for the deformation of the roller or the like and is therefore resistant to the occurrences of wrinkles and peeling. Among them, a thermoplastic polyester based polyurethane, polyether based thermoplastic polyurethane or polycarbonate based polyurethane is preferably used.

As the perfluoroalkyl block of the fluorine based resin to be used for the aforesaid fluorine modifier, a perfluoroalkyl block having 1 to 12 carbon atoms is preferable. The other block which is combined with this perfluoroalkyl block to form the block copolymer is preferably a polyisocyanate block.

These perfluoroalkyl block and polyisocyanate block preferably constitute the block copolymer in which the ratio of fluorine in the total amount of the fluorine based resin is 3 to 80% by weight.

Also, examples of the aforesaid reactive functional group may include such as an isocyanate group, an isocyanate group blocked with an active hydrogen-containing group, an amino group, a hydroxyl group, an epoxy group and a carboxyl group. Among these groups, an isocyanate group blocked with an active hydrogen-containing group is preferable in that a reaction can be suppressed before heat is applied while a base resin, a crosslinking agent, a catalyst and the like are put into a mixed state in advance and therefore this mixture may be used as a one-liquid paint.

Here, the reactive functional group contained in the fluorine based resin is preferably a polyfunctional reactive functional group in that a surface layer can be formed which is more highly suppressed in a variation in the contact angle with a liquid developer caused by the carrier.

As the resin composition for forming the aforesaid surface layer, various ingredients may be used besides the aforesaid base resin and fluorine modifier to the extent that the effect of the present invention is not impaired.

Particularly, particles formed of a fluorine based resin (hereinafter also referred to as "fluorine based resin particle" or "fluorine based resin filler") are formulated in the resin composition to form a surface layer in the condition that these fluorine based resin particles are dispersed, to thereby more highly suppress the occurrence of such a phenomenon that the contact angle with the liquid developer of the surface layer is varied by the carrier and thereby the wet condition of the liquid developer is varied.

Therefore, for example, a fluorine based resin particles are dispersed in the surface layer of the developing roller, and as a result, the liquid developing electrophotographic device using this developing roller can be made to have stable printing ability without any variation in printing performance.

Examples of the fluorine based resin forming this fluorine based resin particles may include such as a polytetrafluoroethylene resin, a perfluoroalkoxy resin, a tetrafluoroethylene-hexafluoropropylene copolymer resin, a tetrafluoroethylene-perfluoroalkyl vinyl ether copolymer resin, a tetrafluoroethylene-ethylene copolymer resin, a polytrifluorochloroethylene resin and a polyvinylidene fluoride resin. Among these resins, a polytetrafluoroethylene resin is preferable.

As the fluorine based resin particles, those having an average particle diameter of 0.3 to 3.0 μm are preferably used.

The reason why the average particle diameter of the fluorine based resin particles is preferably in the aforesaid range is that because, generally, fluorine based resin particles having an average particle diameter less than 0.3 μm are commercially unavailable, it is therefore difficult to get fluorine based resin particles themselves in the market, and even if these fluorine based resin particles are available in the market, they are expensive, and there is a fear that the production cost of the liquid developing electrophotographic device roller may be increased.

In other words, the reason why the average particle diameter of the fluorine based resin particles is preferably 0.3 μm or more is that it can restrain an increase in the production cost of the liquid developing electrophotographic device roller.

On the other hand, fluorine based resin particles having a large average particle diameter are easily available. However, the exposed area occupied by one of the fluorine based resin particles formed on the surface of the liquid developing electrophotographic device roller tends to be larger.

Therefore, it is difficult to form the exposed areas of the fluorine based resin particles in a finely dispersed state on the surface of the liquid developing electrophotographic device roller and there is therefore a fear that the effect of suppressing a variation in the wet condition of the liquid developer is insufficiently exerted.

Specifically, the reason why the average particle diameter of the fluorine based resin particles is preferably 3.0 μm or less is that the effect of suppressing a variation in the wet condition of the liquid developer can be exerted more securely.

Here, this average particle diameter can be determined by measuring the $D_{50}$ value by using, for example, a grain distribution measuring device commercially available under the name of "CAPA-700" from Horiba Ltd.

Also, the fluorine based resin particles are preferably contained in the surface layer-forming resin composition in such a manner as to be dispersed in the surface layer in a ratio of 2.5 to 20.4% by volume.

The reason why the ratio of these fluorine based resin particles in the surface layer is preferably 2.5 to 20.4% by volume is that when the ratio of the fluorine based resin particles dispersed in the surface layer is less than 2.5% by volume, there is a fear that the effect of suppressing a variation in the wet condition of the liquid developer is insufficiently exerted, whereas when the ratio of the fluorine based resin particles dispersed in the surface layer exceeds 20.4% by volume, there is a fear that not only the effect of suppressing a variation in the wet condition of the liquid developer is exerted more than that obtained in the ratio of 20.5% by volume with difficulty, but also the surface roughness of the liquid developing electrophotographic device roller is increased, which rather deteriorates the printing performance of the liquid developing electrophotographic device.

Also, in the case where, for example, a thermoplastic polyurethane is used as the aforesaid base resin on the aforesaid surface layer, a crosslinking agent used to crosslink this thermoplastic polyurethane may be blended.

The molecular motion of the fluorine based resin in the resin composition of the surface layer after the polyurethane is crosslinked can be more highly suppressed by using this crosslinking agent in combination with a fluorine modifier using a fluorine based resin having a polyfunctional reactive functional group. Specifically, the surface layer can be formed which is more highly suppressed in the variation of contact angle with the liquid developer which is caused by the carrier.

As the crosslinking agent used for the crosslinking of the thermoplastic polyurethane in the case of using a thermoplastic polyurethane as the base resin, an isocyanate type is preferable in that it can be combined with a terminal group such as an urethane group, a hydroxyl group or a carboxyl group of this thermoplastic polyurethane to form a chemical bond called allophanate urethane. Among these isocyanate types, a block isocyanate in which an isocyanate group is blocked with a compound containing active hydrogen is allowed to remain suppressed in reactivity in a state of preservation at a normal temperature even in the situation where it is mixed with the thermoplastic polyurethane in advance and therefore, a mixture thereof in a state of uncrosslinking can be reserved. Therefore, it can be prevented from formulating the thermoplastic polyurethane and the crosslinking agent every time when forming the surface layer and from generating surplus materials which must be disposed when these materials are formulated excessively. Specifically, the use of the block isocyanate is particularly preferable from the viewpoint of improving working efficiency in the production of the roller.

Also, carbon black may be formulated in the resin composition used to form this surface layer as described for the developing roller in the first embodiment.

As the aforesaid carbon black used for this surface layer, high conductive carbon black generally called acetylene black besides "KETCHEN BLACK" commercially available from Ketchen Black International Company and "VULCAN" manufactured by Cabot Corporation is preferable.

Also, as the method for producing the developing roller in this second embodiment, the methods used in general to produce a liquid developing electrophotographic device roller may be used like the case of the developing roller of the first embodiment.

For example, after the polyurethane elastic material is provided around the core bar by using a metal mold or the like, the surface of the elastic material layer may be abraded to be adjusted to a given surface smoothness, thereby forming a base material layer.

Also, for example, the thermoplastic polyurethane is dissolved in a solvent and a fluorine modifier and carbon black are dispersed in the mixed solution to prepare a polyurethane solution, which is then applied directly onto the surface of the base material layer formed in the aforesaid manner by dip coating or the like, followed by heat treating to react the thermoplastic polyurethane with the fluorine based resin used in the fluorine modifier, while removing the solvent of the polyurethane solution, thereby forming the surface layer. Also, if necessary, the isocyanate based crosslinking agent is blended in this polyurethane solution to crosslink the thermoplastic polyurethane itself while reacting the thermoplastic polyurethane with the fluorine based resin.

Here, as the solvent used to dissolve this thermoplastic polyurethane, methyl ethyl ketone, tetrahydrofuran, isopropyl alcohol, butyl acetate or ethyl acetate or a mixture thereof is preferably used from the viewpoint of highly solubilizing to the thermoplastic polyurethane and the suppression of the swelling of the elastic material layer.

Furthermore, the surface of the surface layer is preferably formed so as to have a surface roughness of 3 μm or less in terms of ten point height of roughness profile (Rz) prescribed in JIS B 0601.

Then, the abrading roller 9 as a third embodiment of the liquid developing electrophotographic device roller is described.

This abrading roller 9 is constituted of a core bar which is to be the shaft and an elastic material layer which is formed of an elastic material on the outer periphery of this core bar.

Specifically, this elastic material layer is formed on the outermost peripheral side of the abrading roller 9 and is provided around the outer peripheral surface of the abrading roller 9 in an exposed state.

This elastic material layer is formed of a polyurethane obtained by reacting a polyester polyol with a difunctional isocyanate. An abrasive agent is formulated in this polyurethane and the elastic material layer is formed in such a manner that the JIS-A hardness thereof is 40 to 70 degrees, wherein the formulated abrasive agent is provided on the surface of the roller in the condition that the abrasive agent is exposed from the outer peripheral surface.

The reason why the elastic material layer is designed to have a JIS-A hardness of 40 to 70 degrees is that when this hardness is less than 40 degrees, the elastic material layer is too soft and it is therefore difficult to impart sufficient abrading performance to the photoreceptor, whereas when this hardness exceeds 70 degrees, not only it becomes difficult to allow the elastic material layer to be in contact with the photoreceptor in a proper contact width but also the abrading performance becomes too high and there is therefore a fear that the surface of the photoreceptor is excessively abraded.

Therefore, the abrading performance suitable for the liquid developing electrophotographic abrading roller can be imparted by forming an elastic material layer having a JIS-A hardness of 40 to 70 degrees in this abrading roller.

Here, this JIS-A hardness means the Type A Duro-meter Hardness (instantaneous value) prescribed in JIS K 6253 which is measured in normal condition.

As the abrasive agent to be used in this abrading roller, though it is not limited to, powders of alumina, silica, chromium oxide, zirconium oxide, cerium oxide, iron oxide, diamond and the like may be used either singly or by mixing two or more of these powder materials. Also, the abrasive agent may be used by dispersing it in the elastic material layer such that the content of the abrasive agent in the elastic material layer becomes 0.5 to 30% by weight.

The reason why the amount of the abrasive agent to be formulated is designed to be 0.5 to 30% by weight is that when the amount of the abrasive agent to be formulated is less than 0.5% by weight, it is difficult to impart sufficient abrading performance to the photoreceptor, whereas when the amount of the abrasive agent exceeds 30% by weight, the abrading performance is too high and there is therefore a fear that the surface of the photoreceptor is excessively abraded. Furthermore, even if it is intended to formulate the abrasive agent in an amount exceeding 30% by weight, the viscosity of the mixture of the polyurethane and abrasive agent becomes too high, so that a uniformly dispersed state is scarcely formed and also, the handling property in the production step is deteriorated, which makes it difficult to carry out injection molding or the like.

Therefore, the abrading performance suitable for the liquid developing electrophotographic abrading roller can be imparted and also, the abrading roller can be easily produced by formulating the abrasive agent in an amount of 0.5 to 30% by weight in the elastic material layer of this abrading roller.

Also, as to the average particle diameter of this abrasive agent, an abrasive agent having an average particle diameter of 0.5 to 2.5 μm may be used. Here, this average particle diameter may be measured, for example, by calculating the 50% value in a cumulative grain size distribution curve obtained by the laser diffraction method or the like.

Among the aforesaid abrasive agents, cerium oxide is preferable in that it has higher abrading efficiency than that of iron oxide, zirconium oxide or the like.

Also, the reason why a polyester polyol is used for the aforesaid polyurethane is that when other polyols are used, the elastic material layer is easily swollen with a material, such as liquid paraffin, silicon oil, mineral oil or vegetable oil, which is usually used as the carrier and therefore, the volumetric variation of the elastic material layer (developing roller) exceeds, for example, 10%, so that the abraded condition of the surface of the photoreceptor is varied with a variation in the volume of the abrading roller, with the result that the printing accuracy of the liquid developing electrophotographic device is deteriorated.

As the polyester polyol and difunctional isocyanate used in the elastic material layer of this abrading roller, the same ones that are used in the developing roller described in the first and second embodiments may be used.

Also, as to the production method, the same method that is used in the production of the developing roller described in the first and second embodiments may be adopted, and for example, a method may be adopted in which a polyurethane elastic material is provided around a core bar by using a metal mold or the like and then, the surface of the elastic material layer is abraded.

Here, when the abrading roller as mentioned above is used in the liquid developing electrophotographic device, it is preferable to bring the abrading roller into contact with the photoreceptor with rotating it at a circumferential speed difference by 1% or more from that of the aforesaid photoreceptor to thereby abrade the surface of the photoreceptor in that the surface of the photoreceptor can be surely cleaned. It is particularly preferable to bring the abrading roller into contact with the photoreceptor with rotating it in the same direction as the photoreceptor at a circumferential speed difference by 1% or more from that of the photoreceptor to thereby allow the surfaces of the both to move in a direction opposite to each other thereby abrading the surface of the photoreceptor.

Here, in the aforesaid descriptions, the case where the abrading roller is formed only of the elastic material layer in which an abrasive agent is dispersed and the core bar is given as an example. However, the elastic material layer may be formed without containing the abrasive agent and a surface layer in which the abrasive agent is dispersed may be provided on the outer peripheral side of the elastic material layer.

The abrading roller provided with the surface layer like this may be produced in the same method as in the case of the developing roller of the second embodiment.

For example, the following production method may be adopted. Specifically, the thermoplastic polyurethane is dissolved in a solvent and the abrasive agent is further dispersed in the solution to manufacture a polyurethane solution. After the polyurethane elastic material is provided around the core bar by using a metal mold or the like, the surface of the elastic material is abraded and then, the aforesaid polyurethane solution is used to form a surface layer by dip coating or the like.

Here, in the aforesaid description, the developing roller and the abrading roller are described as examples, the liquid developing electrophotographic device roller of the present invention is not particularly limited to these rollers and it is intended in all of rollers, such as a toner drawing roller, running-in roller, squeeze roller, intermediate roller and pressure roller, which are provided with an elastic material layer provided around the outer peripheral side of a shaft.

Here, in the liquid developing electrophotographic device, a liquid toner (liquid developer) is used together with these liquid developing electrophotographic device rollers. In this case, it is preferable that the polyester polyol used to form the elastic material layer of the liquid developing electrophotographic device roller and the carrier used in this liquid developer are preferably put into the situation where the sp values of the both are different by 2 or more from each other.

Specifically, in the liquid developing electrophotographic device using a liquid developer obtained by dispersing a toner in a carrier, the liquid developing electrophotographic device roller is preferably a roller in which a polyurethane obtained by reacting a difunctional isocyanate with a polyester polyol having a sp value larger by 2 or more than the sp value of the aforesaid carrier is used in the elastic material layer.

When a liquid developing electrophotographic device roller provided with such an elastic material layer and a liquid developer are used, the occurrence of such a phenomenon that the elastic material layer of the liquid developing electrophotographic device roller is swollen with the carrier can be suppressed, so that the volumetric variation can be more highly restricted, with the result that a deterioration in the printing accuracy of the liquid developing electrophotographic device can be even more highly suppressed.

Liquid paraffin, silicon oil, mineral oil, vegetable oil or the like is usually used for the carrier of this liquid toner (liquid developer). Among these carrier materials, hydrocarbon based carriers such as liquid paraffin have a relatively high sp value (hereinafter, referred to as "solubility parameter") and usually have a sp value of 6 to 8.

Therefore, when the polyester polyol used to form the elastic material layer of the liquid developing electrophotographic device roller is made to have a sp value of 10 or more, it has a larger sp value by 2 or more than a carrier usually used, which can restrain the situation where suppressions are imposed on the carrier of the liquid toner used to obtain excellent printing accuracy.

Here, the term "sp value" in this specification means the value calculated by the method proposed by Fedors and is given by the following equation.

$$sp\ \text{value}=\{\Sigma(\Delta e_i)/\Sigma(\Delta v_i)\}^{0.5}$$

where, "$\Sigma(\Delta e_i)$" represents the sum of coagulation energies ($\Delta e_i$: cal/mol) per each unit functional group and "$\Sigma(\Delta v_i)$" represents the sum of molecular volumes ($\Delta v_i$: $cm^3$/mol) per each unit functional group.

For example, in the case of using, as the liquid toner, a liquid toner using isoparaffin (sp value: usually 8.0) as the carrier, it is preferable to use a liquid developing electrophotographic device roller formed with an elastic material layer using a polyester polyol having a sp value of 10 or more.

As the polyester polyol having this sp value of 10 or more, though it is not particularly limited to, a polyester polyol obtained by reacting adipic acid with difunctional glycol and trimethylolpropane is preferably used.

The reason why adipic acid is preferable as the raw material component of this polyester polyol is that when using adipic acid, the sp value of the polyester polyol can be made higher than in the case of using other dicarboxylic acids such as sebacic acid, with the result that the elastic material layer formed using this polyester polyol can be made to be more highly reduced in volumetric variation caused by the carrier. Accordingly, the use of adipic acid as the raw material component ensures that a reduction in the printing accuracy of the liquid developing electrophotographic device can be more highly suppressed.

Also, the difunctional glycol is preferably a difunctional glycol having 2 to 5 carbon atoms and specifically preferably, any one of diethylene glycol, 1,4-butanediol and 3-methylpentanediol.

When this difunctional glycol is the difunctional glycol having 2 to 5 carbon atoms and particularly, any one of diethylene glycol, 1,4-butanediol and 3-methylpentanediol, the sp value of the polyester polyol can be raised with the result that the elastic material layer formed using this polyester polyol can be made to be more highly reduced in volumetric variation caused by the carrier. Accordingly, a reduction in the printing accuracy of the liquid developing electrophotographic device can be more highly suppressed.

EXAMPLES

The present invention will be described in detail by way of examples, however, the present invention is not intended to be limited to examples.

(Study of Formulation of Polyurethane Elastic Material-Study 1)

Formulation Examples 1 to 39

A polyol and an isocyanate as described in Table 1 were formulated so as to have a hardness as shown in Table 1 after curing to manufacture a polyurethane elastic material sample.

Here, the hardness shown in Table 1 is the Type A Durometer Hardness (JIS-A hardness) prescribed in JIS K 6253 which was measured in normal condition.

Also, the manufactured polyurethane elastic material having each formulation was cut into a size of 30 mm (width)×30 mm (length)×2 mm (thickness) to manufacture a rectangular parallelopiped sample and the produced rectangular parallelopiped sample was immersed in a hydrocarbon based carrier (trade name: "IsoparM", manufactured by Exxon Mobil Corporation) containing isoparaffin as its major component for a total of 7 days to measure a variation in the volume of each sample with the passage of immersing days.

At this time, as the temperature of "IsoparM" to be immersed, two temperatures 23° C. and 40° C. were adopted to make tests, and as to the rate of volumetric variation, the width and length were measured using a calipers and the thickness was measured according to the method described in JIS K 6258 to measure the volume (width×length×thickness), with expressing an increase in volume from the initial volume by percentages.

Table 1 shows the results of the rate of volumetric variation of each formulation example in the immersing tests at 23° C. and 40° C. (7 days after immersed).

In addition, Table 1 shows the results of the sp value of the used polyester polyol measured by the method proposed by Fedors (the following equation).

$$sp\ \text{value}=\{\Sigma(\Delta e_i)/\Sigma(\Delta v_i)\}^{0.5}$$

where, "$\Sigma(\Delta e_i)$" represents the sum of coagulation energies ($\Delta e_i$: cal/mol) per each unit functional group and "$\Sigma(\Delta v_i)$" represents the sum of molecular volumes ($\Delta v_i$: $cm^3$/mol) per each unit functional group.

Here, the sp value of "IsoparM", which was a carrier, was 8.0.

Also, Table 2 shows the results of measurement of the rate of volumetric variation 0.5, 1, 2, 3, 5 and 7 days after the start of the immersing test with regard to the polyurethane elastic material samples in the formulation examples 1, 28, 34, 38 and 39.

TABLE 1

| | Polyurethane | | | | Rate of volumetric variation (%) | |
|---|---|---|---|---|---|---|
| | Polyol (dicarboxylic component: glycol component: polyhydric alcohol component) | sp Value | Isocyanate | Hardness | 23° C. | 40° C. |
| Formulation Example 1 | Polyester polyol (adipic acid:diethylene glycol:trimethylolpropane), | 10.7 | TDI | 31 | 0.8 | 0.8 |
| Formulation Example 2 | Polyester polyol (adipic acid:diethylene glycol:trimethylolpropane), | 10.7 | TDI | 48 | 0.6 | 0.7 |
| Formulation Example 3 | Polyester polyol (adipic acid:diethylene glycol:trimethylolpropane), | 10.7 | XDI | 35 | 1.0 | 1.2 |
| Formulation Example 4 | Polyester polyol (adipic acid:diethylene glycol:trimethylolpropane), | 10.7 | XDI | 50 | 0.8 | 1.1 |
| Formulation Example 5 | Polyester polyol (adipic acid:1,4-butandiol:trimethylolpropane) | 10.5 | TDI | 33 | 1.6 | 1.8 |
| Formulation Example 6 | Polyester polyol (adipic acid:1,4-butandiol:trimethylolpropane) | 10.5 | TDI | 52 | 1.2 | 1.3 |
| Formulation Example 7 | Polyester polyol (adipic acid:1,4-butandiol:trimethylolpropane) | 10.5 | XDI | 35 | 1.6 | 1.8 |
| Formulation Example 8 | Polyester polyol (adipic acid:1,4-butandiol:trimethylolpropane) | 10.5 | XDI | 52 | 1.2 | 1.3 |
| Formulation Example 9 | Polyester polyol (adipic acid:3-methylpentanediol:trimethylolpropane) | 10.1 | TDI | 33 | 2.0 | 2.5 |
| Formulation Example 10 | Polyester polyol (adipic acid:3-methylpentanediol:trimethylolpropane) | 10.1 | TDI | 48 | 1.6 | 1.8 |
| Formulation Example 11 | Polyester polyol (adipic acid:3-methylpentanediol:trimethylolpropane) | 10.1 | XDI | 35 | 1.6 | 2.7 |
| Formulation Example 12 | Polyester polyol (adipic acid:3-methylpentanediol:trimethylolpropane) | 10.1 | XDI | 52 | 1.2 | 2.3 |
| Formulation Example 13 | Polyester polyol (adipic acid:diethylene glycol:trimethylolpropane) | 10.7 | TDI | 28 | 0.8 | 1.0 |
| Formulation Example 14 | Polyester polyol (adipic acid:diethylene glycol:trimethylolpropane) | 10.7 | TDI | 62 | 0.5 | 0.8 |
| Formulation Example 15 | Polyester polyol (adipic acid:diethylene glycol:trimethylolpropane) | 10.7 | XDI | 27 | 0.9 | 1.3 |
| Formulation Example 16 | Polyester polyol (adipic acid:diethylene glycol:trimethylolpropane) | 10.7 | XDI | 60 | 0.8 | 0.9 |
| Formulation Example 17 | Polyester polyol (adipic acid:1,4-butandiol:trimethylolpropane) | 10.5 | TDI | 28 | 1.7 | 2.0 |
| Formulation Example 18 | Polyester polyol (adipic acid:1,4-butandiol:trimethylolpropane) | 10.5 | TDI | 59 | 1.7 | 1.9 |
| Formulation Example 19 | Polyester polyol (adipic acid:1,4-butandiol:trimethylolpropane) | 10.5 | XDI | 28 | 1.8 | 2.3 |
| Formulation Example 20 | Polyester polyol (adipic acid:1,4-butandiol:trimethylolpropane) | 10.5 | XDI | 60 | 1.8 | 2.2 |
| Formulation Example 21 | Polyester polyol (adipic acid:3-methylpentenediol:trimethylolpropane) | 10.1 | TDI | 27 | 1.9 | 2.4 |
| Formulation Example 22 | Polyester polyol (adipic acid:3-methylpentenediol:trimethylolpropane) | 10.1 | TDI | 60 | 1.8 | 2.2 |
| Formulation Example 23 | Polyester polyol (adipic acid:3-methylpentenediol:trimethylolpropane) | 10.1 | XDI | 28 | 2.3 | 2.8 |
| Formulation Example 24 | Polyester polyol (adipic acid:3-methylpentenediol:trimethylolpropane) | 10.1 | XDI | 61 | 2.0 | 2.4 |
| Formulation Example 25 | Polyester polyol (adipic acid:diethylene glycol:trimethylolpropane) | 10.7 | MDI | 37 | 2.2 | 2.8 |
| Formulation Example 26 | Polyester polyol (adipic acid:1,4-butandiol:trimethylolpropane) | 10.5 | MDI | 42 | 1.9 | 2.6 |
| Formulation Example 27 | Polyester polyol (adipic acid:3-methylpentanediol:trimethylolpropane) | 10.1 | MDI | 49 | 1.7 | 2.7 |
| Formulation Example 28 | Polyester polyol (adipic acid:diethylene glycol:trimethylolpropane) | 9.8 | TDI | 35 | 2.8 | 3.5 |
| Formulation Example 29 | Polyester polyol (adipic acid:diethylene glycol:trimethylolpropane) | 9.8 | XDI | 47 | 2.5 | 3.1 |
| Formulation Example 30 | Polyester polyol (adipic acid:1,4-butandiol:trimethylolpropane) | 9.6 | TDI | 33 | 3.2 | 3.6 |
| Formulation Example 31 | Polyester polyol (adipic acid:1,4-butandiol:trimethylolpropane) | 9.6 | XDI | 49 | 3.1 | 3.6 |
| Formulation Example 32 | Polyester polyol (adipic acid:3-methylpentanediol:trimethylolpropane) | 9.5 | TDI | 36 | 3.5 | 4.0 |
| Formulation Example 33 | Polyester polyol (adipic acid:3-methylpentanediol:trimethylolpropane) | 9.5 | XDI | 52 | 3.3 | 3.8 |
| Formulation Example 34 | Polyester polyol (adipic acid:1,6-hexanediol:trimethylolpropane) | 9.5 | TDI | 38 | 3.5 | 4.2 |
| Formulation Example 35 | Polyester polyol (adipic acid:1,6-hexanediol:trimethylolpropane) | 9.5 | XDI | 50 | 3.4 | 4.0 |
| Formulation Example 36 | Polyester polyol (adipic acid:1,9-nonanediol:trimethylolpropane) | 9.3 | TDI | 37 | 3.9 | 4.8 |
| Formulation Example 37 | Polyester polyol (adipic acid:1,9-nonanediol:trimethylolpropane) | 9.3 | XDI | 52 | 4.0 | 4.7 |
| Formulation Example 38 | PPG (polyoxypropylene glycol) | | TDI | 43 | 13.0 | 21.0 |
| Formulation Example 39 | Polybutadienepolyol(1,4-polybutadienepolyol) | | TDI | 45 | 21.0 | 38.0 |

*As the polyester polyols of Formulation Examples 1 to 4, 13 to 16 and 25, those which were commercially available under the name of "Nipporan N4032" from Nippon Polyurethane Industry Co., Ltd. were used.

Also, as the polyester polyols of Formulation Examples 9 to 12, 21 to 24 and 27, those which were commercially available under the name of "Kuraray Polyol F3010" from Kuraray Co., Ltd. were used.

As all of the polyester polyols in other Formulation Examples, synthetic polyester polyols were used.

TABLE 2

| | | Immersing days (days) | | | | | |
|---|---|---|---|---|---|---|---|
| | | 0.5 | 1 | 2 | 3 | 5 | 7 |
| Formulation | 23° C. | 0.0 | 0.2 | 0.5 | 0.6 | 0.8 | 0.8 |
| Example 1 | 40° C. | 0.1 | 0.3 | 0.6 | 0.8 | 0.8 | 0.8 |
| Formulation | 23° C. | 0.7 | 1.4 | 1.8 | 2.5 | 2.8 | 2.8 |
| Example 28 | 40° C. | 1.0 | 1.8 | 2.8 | 3.0 | 3.3 | 3.5 |
| Formulation | 23° C. | 0.9 | 1.6 | 2.0 | 2.7 | 3.2 | 3.5 |
| Example 34 | 40° C. | 1.8 | 2.2 | 2.9 | 3.5 | 4.0 | 4.2 |
| Formulation | 23° C. | 5.1 | 7.8 | 9.5 | 11.0 | 12.0 | 13.0 |
| Example 38 | 40° C. | 8.4 | 11.6 | 14.2 | 16.3 | 18.8 | 21.0 |
| Formulation | 23° C. | 7.0 | 12.8 | 16.3 | 18.0 | 19.3 | 21.0 |
| Example 39 | 40° C. | 12.5 | 17.2 | 22.6 | 27.4 | 33.5 | 38.0 |

*Each value in the table shows the rate of volumetric variation (%).

It is also found from the aforesaid Tables 1 and 2 that the polyurethane obtained by reacting a polyester polyol with a difunctional isocyanate is scarcely swollen with a material, such as liquid paraffin, usually used as a carrier so that it is scarcely varied in volume.

It is also found that the polyurethane using adipic acid as this polyester polyol is more highly reduced in volumetric variation than in the case of using other dicarboxylic acids such as sebacic acid and the polyurethane using, as the difunctional glycol, those having 2 to 6 carbon atoms and, particularly, any one of diethylene glycol, 1,4-butanediol and 3-methylpentanediol is more resistant to a variation in volume than those using other difunctional glycols.

Furthermore, it is also found that in the case of using tolyleneisocyanate (TDI) or xylenediisocyanate (XDI) as the difunctional isocyanate to be reacted with this polyester polyol, a variation in the volume of the elastic material layer caused by the carrier can be made to be smaller than in the case of using diphenylmethanediisocyanate (MDI) or the like.

Also, Formulation Example 1 which is a polyurethane obtained by reacting a polyester polyol having a sp value larger by 2 or more than the sp value of the carrier with a difunctional isocyanate is more resistant to a variation in volume than Formulation Examples 28 and 34 each of which is a polyurethane obtained by reacting a polyester polyol having a sp value less than (sp value of the carrier+2) with a difunctional isocyanate.

Example 1

An elastic material layer of about 3 mm in thickness was provided around a core bar of 10 mm in diameter by using a polyurethane having the formulation shown in Table 3 and the surface of the elastic material layer was abraded in such a manner that the outside diameter of the elastic material became about 16 mm. Then, a polyurethane solution shown in Table 4 was applied to the surface of the elastic material to form a surface layer, thereby manufacturing a developing roller of Example 1.

More specifically, carbon black (trade name: "KETCHEN BLACK EC300J", manufactured by Ketchen Black International Company) was mixed and dispersed in a polyester polyol, and the mixture was subjected to dewatering treatment and was heated to 100° C. Then, a difunctional isocyanate and bis(dipropylphenyl) carbodiimide were added to the mixture and the mixture was stirred to be a uniformly mixed solution, which was then injected into a 150° C. metal mold to which the core bar was set, and the mixture was reacted for one hour to provide an elastic material layer on the outer peripheral side of the core bar. After reacting at 150° C. for one hour, the article was released from the metal mold and then treated at 140° C. for 2 hours for post-crosslinking to manufacture a pre-molded article.

This pre-molded article was surface-abraded by a cylindrical grinder into a prescribed dimension and the polyurethane solution shown in Table 4 was applied to the surface of the article by dip coating, followed by drying at 110° C. for 2 hours to manufacture a developing roller of Example 1.

Examples 2, 3 and 5 to 7, Comparative Examples 1 and 2

Developing rollers were manufactured in the same manner as in Example 1 except that the formulation of the polyurethane was changed as shown in Table 3.

Example 4

MDI was used as the difunctional isocyanate. A developing roller was manufactured in the same manner as in Example 1 except for the following processes. In this Example 4, the elastic material layer was cured so slowly that it was difficult to release the article from the mold in the reaction condition of 150° C.×1 Hr. Therefore, the reaction condition was changed to 150° C.×24 Hr and furthermore, the crosslinking time after the article was released from the mold was changed to 24 hours.

TABLE 3

| | Formulation | |
|---|---|---|
| | Polyurethane | Others |
| Example 1 | Formulation 1 (Polyester polyol 100 parts by weight + TDI 7.5 parts by weight) | +carbon black 0.7 parts by weight and bis(dipropylbiphenyl)carbodiimide 1.0 part by weight |
| Example 2 | Formulation 5 (Polyester polyol 100 parts by weight + TDI 7.5 parts by weight), | |
| Example 3 | Formulation 9 (Polyester polyol 100 parts by weight + TDI 7.5 parts by weight), | |
| Example 4 | Formulation 25 (Polyester polyol 100 parts by weight + MDI 8.5 parts by weight) | |
| Example 5 | Formulation 28 (Polyester polyol 100 parts by weight + TDI 7.5 parts by weight) | |

TABLE 3-continued

| | Formulation | |
|---|---|---|
| | Polyurethane | Others |
| Example 6 | Formulation 34 (Polyester polyol 100 parts by weight + TDI 7.5 parts by weight) | |
| Example 7 | Formulation 36 (Polyester polyol 100 parts by weight + TDI 7.5 parts by weight) | |
| Comparative Example 1 | Formulation 38 (PPG 100 parts by weight + TDI 8.0 parts by weight) | |
| Comparative Example 2 | Formulation 39 (Polybutadienepolyol 100 parts by weight + TDI 8.0 parts by weight) | |

TABLE 4

| Formulation of a surface layer-forming polyurethane solution | |
|---|---|
| Thermoplastic polyester based polyurethane | 10 parts by weight |
| Carbon black | 5 parts by weight |
| Solvent (tetrahydrofuran) | 100 parts by weight |

(Evaluation of Carrier Resistance)

Each developing roller of Examples and Comparative Examples was subjected to a carrier resistance test in which it was supported horizontally to put the roller in such a state that the lower half thereof was immersed in a liquid toner (about 30° C.) using isoparaffin as the carrier to rotate the developing roller at a rotating rate of about 200 rpm while using a blade to scrape a liquid film of the liquid toner formed along the rotation on the surface of the roller.

The hardness (JIS-A hardness), variation in outside diameter and variation in electric resistance (resistance when 100 V was applied across the core bar-surface) of the developing roller at this time were measured.

Specifically, with regard to the developing rollers of Examples 1 to 7, the values in the initial state and the values 7 days after the carrier resistance test were measured.

With regard to the developing roller of Comparative Example 1, it was largely swollen (volumetric change was large) and therefore, the values in the initial state and the values 4 days after the carrier resistance test were measured.

With regard to the developing roller of Comparative Example 2, it was more largely swollen (volumetric change was large) and therefore, the values in the initial state and the values 2 days after the carrier resistance test were measured.

The results are shown in Table 5.

It is also understood from Table 5 that the polyurethane obtained by reacting a polyester polyol with a difunctional isocyanate is resistant to volumetric variation in a material, such as liquid paraffin, which is usually used as the carrier.

It is also found that a polyurethane using adipic acid as the polyester polyol is more highly reduced in volumetric variation than that using other carboxylic acid such as sebacic acid as the polyester polyol, and that a polyurethane obtained using, as the difunctional glycol, one having 2 to 6 carbon atoms and particularly, any one of diethylene glycol, 1,4-butanediol and 3-methylpentanediol is more resistant to a variation in volume than in the case of using other difunctional glycols.

It is further found that a variation in the volume of the elastic material layer caused by the carrier can be more highly reduced by using, as the difunctional isocyanate to be reacted with the polyester polyol, tolylenediisocyanate or xylenediisocyanate than in the case of using diphenylmethanediisocyanate or the like.

Also, in the rollers of Examples 5 to 7 using a polyurethane obtained by reacting a polyester polyol having a sp value less than (sp value of the carrier+2) with a difunctional isocyanate, the variation in the outside diameter of the roller before and after the carrier resistance test is slightly larger than that of the rollers of Examples 1 to 4. It is therefore found that the use of a polyurethane obtained by reacting a polyester polyol having a sp value large by 2 or more than the sp value of the carrier can furthermore suppress a reduction in the printing accuracy of the liquid developing electrophotographic device.

(Study of Formulation of Polyurethane Elastic Material-Study 2)

TABLE 5

| | | Example 1 | Example 2 | Example 3 | Example 4 | Example 5 | Example 6 | Example 7 | Comparative Example 1 | Comparative Example 2 |
|---|---|---|---|---|---|---|---|---|---|---|
| Variation in hardness (degree) | Initial stage | 33 | 35 | 36 | 38 | 36 | 40 | 39 | 45 | 47 |
| | After a carrier resistance test | 33 | 35 | 36 | 36 | 34 | 36 | 36 | 40 | 40 |
| Outside diameter of the roller (mm) | Initial stage | 16.02 | 16.01 | 16.01 | 16.01 | 16.01 | 16.01 | 16.01 | 16.00 | 16.03 |
| | After a carrier resistance test | 16.02 | 16.01 | 16.01 | 16.04 | 16.08 | 16.11 | 16.13 | 17.56 | 17.82 |
| Electric resistance ($\times 10^5\ \Omega$) | Initial stage | 7.6 | 8.0 | 7.3 | 6.8 | 7.4 | 6.9 | 6.8 | 7.9 | 8.3 |
| | After a carrier resistance test | 7.8 | 8.2 | 7.5 | 7.0 | 7.5 | 7.0 | 7.0 | 35 | 46 |

*With regard to the column "After a carrier resistance test", the data was obtained as follows: the data of Examples 1 to 7 was obtained 7 days after the carrier resistance test, the data of Comparative Example 1 was obtained 4 days after the carrier resistance test, and the data of Comparative Example 2 was obtained 2 days after the carrier resistance test.

Formulation Examples 40 to 59

A polyol and an isocyanate as described in Table 6 were formulated so as to have a hardness as shown in Table 6 after curing to manufacture a polyurethane elastic material sample.

Here, the hardness shown in Table 6 is the Type A Durometer Hardness (instantaneous value) prescribed in JIS K 6253 which was measured in normal condition.

Also, the average number (value) of functional groups and acid value of this polyol are also shown in Table 6.

TABLE 6

| | Polyurethane | | | | |
|---|---|---|---|---|---|
| | Polyol (dicarboxylic component: glycol component: polyhydric alcohol component) | Isocyanate | Hardness | f value | Acid value |
| Formulation Example 40 | Polyester polyol (adipic acid:3-methylpentanediol:trimethylolpropane) | TDI | 35 | 3.02 | 0.22 |
| Formulation Example 41 | Polyester polyol (adipic acid:3-methylpentanediol:trimethylolpropane) | TDI | 33 | 3.12 | 0.50 |
| Formulation Example 42 | Polyester polyol (adipic acid:3-methylpentanediol:trimethylolpropane) | TDI | 35 | 3.17 | 0.43 |
| Formulation Example 43 | Polyester polyol (adipic acid:3-methylpentanediol:trimethylolpropane) | TDI | 45 | 3.02 | 0.22 |
| Formulation Example 44 | Polyester polyol (adipic acid:3-methylpentanediol:trimethylolpropane) | TDI | 53 | 3.12 | 0.50 |
| Formulation Example 45 | Polyester polyol (adipic acid:3-methylpentanediol:trimethylolpropane) | TDI | 55 | 3.02 | 0.22 |
| Formulation Example 46 | Polyester polyol (adipic acid:3-methylpentanediol:trimethylolpropane) | XDI | 33 | 3.02 | 0.22 |
| Formulation Example 47 | Polyester polyol (adipic acid:3-methylpentanediol:trimethylolpropane) | XDI | 34 | 3.12 | 0.50 |
| Formulation Example 48 | Polyester polyol (adipic acid:3-methylpentanediol:trimethylolpropane) | XDI | 32 | 3.17 | 0.43 |
| Formulation Example 49 | Polyester polyol (adipic acid:3-methylpentanediol:trimethylolpropane) | XDI | 46 | 3.02 | 0.22 |
| Formulation Example 50 | Polyester polyol (adipic acid:3-methylpentanediol:trimethylolpropane) | XDI | 57 | 3.02 | 0.22 |
| Formulation Example 51 | Polyester polyol (adipic acid:diethylene glycol:trimethylolpropane) | TDI | 35 | 2.30 | 1.35 |
| Formulation Example 52 | Polyester polyol (adipic acid:3-methylpentanediol:trimethylolpropane) | TDI | 34 | 2.10 | 0.27 |
| Formulation Example 53 | Polyester polyol (adipic acid:3-methylpentanediol:trimethylolpropane) | TDI | 32 | 2.20 | 0.24 |
| Formulation Example 54 | PPG (polyoxypropylene glycol) | XDI | 39 | — | — |
| Formulation Example 55 | Polybutadienepolyol (1,4-polybutadienepolyol) | XDI | 40 | — | — |
| Formulation Example 56 | Polyester polyol (adipic acid:3-methylpentanediol:trimethylolpropane) | TDI | 28 | 3.02 | 0.22 |
| Formulation Example 57 | Polyester polyol (adipic acid:3-methylpentanediol:trimethylolpropane) | TDI | 61 | 3.02 | 0.22 |
| Formulation Example 58 | Polyester polyol (adipic acid:3-methylpentanediol:trimethylolpropane) | XDI | 29 | 3.02 | 0.22 |
| Formulation Example 59 | Polyester polyol (adipic acid:3-methylpentanediol:trimethylolpropane) | XDI | 63 | 3.02 | 0.22 |

Example 8

The polyurethane of Formulation Example 40 was poured into an injection mold heated at 150° C. and crosslinked at 150° C.×1 Hr and then, the article was released from the mold, followed by furthermore post-crosslinking at 160° C.×2 Hr to manufacture a pre-molded article in which an elastic material layer having a thickness slightly larger than 3 mm which was provided around a core bar having a diameter of 6 mm.

This pre-molded article was surface-abraded by a cylindrical grinder to manufacture a developing roller having an outside diameter of 12 mm.

Examples 9 to 25, Comparative Examples 3 and 4

Developing rollers of Examples 9 to 21 were manufactured in the same manner as in Example 8 except that the formulation of the polyurethane to be used was altered to Formulation Examples 41 to 53.

Also, developing rollers of Comparative Examples 3 and 4 were manufactured in the same manner as in Example 8 except that the formulation of the polyurethane to be used was altered to Formulation Examples 54 to 55.

Furthermore, developing rollers of Examples 22 to 25 were manufactured in the same manner as in Example 8 except that the formulation of the polyurethane to be used was altered to the Formulation Examples 56 to 59.

(Carrier Resistance)

Each roller of Examples and Comparative Examples was immersed in a hydrocarbon based carrier (trade name: "IsoparM", manufactured by Exxon Mobil Corporation) containing isoparaffin as its major component and in a silicon oil based carrier (trade name: "SH-200", manufactured by Dow Corning Toray Silicone Co., Ltd.) for a total of 7 days to determine how the volume of each roller was varied with the passage of time.

Here, as the temperature of the hydrocarbon based carrier, two temperatures 23° C. and 40° C. were adopted to make tests, and as to the rate of volumetric variation, the outside diameter of the roller after the roller was immersed in the hydrocarbon based carrier was measured to calculate the volume of the elastic material layer based on this outside diameter, with expressing an increase in volume from the initial volume by percentages.

The results are shown in Table 7.

(Rate of Volumetric Variation: Measurement of Dimensional Variation with Environmental Change)

After each roller of Examples and Comparative Examples was kept under a low-temperature and low-humidity environment (temperature: 10° C., relative humidity: 10%) for 24 hours, and the outside diameter of the roller was measured in a non-contact state by a laser dimension measuring device, each roller was then kept under a high-temperature and high-humidity environment (temperature: 30° C., relative humidity: 85%) for 24 hours.

After each roller of Examples and Comparative Examples was kept under this high-temperature and high-humidity environment, the outside diameter of the roller was again measured in a non-contact state by a laser dimension measuring device and then kept under a standard environment (temperature: 23° C., relative humidity: 50%) for 24 hours.

After each roller of Examples and Comparative Examples was kept under this standard environment, the outside diameter of the roller was again measured in a non-contact state by a laser dimension measuring device.

The measurements of the outside diameter after the roller was kept under this low-temperature and low-humidity environment for 24 hours, after the roller was kept under this high-temperature and high-humidity environment for 24 hours and after the roller was kept under this normal environment for 24 hours were made at three positions of each roller.

Also, the outside diameter was measured in such a manner that the measuring position after the roller was kept under the high-temperature and high-humidity environment for 24 hours and after the roller was kept under the standard environment for 24 hours was almost the same as that after the roller was kept under the low-temperature and low-humidity environment for 24 hours.

When the measured average value of the outside diameter after the roller was kept under a low-temperature and low-humidity environment for 24 hours was set to $X_L$, the measured average value of the outside diameter after the roller was kept under a high-temperature and high-humidity environment for 24 hours was set to $X_H$, and the measured average value of the outside diameter after the roller was kept under a standard environment for 24 hours was set to $X_N$, the rate of dimensional variation was found by the following equation.

$$\text{Rate of dimensional variation } (\%)=(X_H-X_L)/X_N\times 100(\%)$$

The results are shown in Table 7.

(Compression Set)

Each sample formed using the same formulations as those used for forming the elastic material layer of Examples and Comparative Example was used to measure the compression set based on JIS K 6262.

The results are shown in Table 7.

TABLE 7

| | Formulation to be used | Polyurethane to be used: Polyol | Polyurethane to be used: (Glycol component) | Carrier resistance (volumetric variation: %) IsoparM 23° C. | IsoparM 40° C. | SH-200 23° C. | SH-200 40° C. | Rate of volumetric variation (%) | Compression set (%) |
|---|---|---|---|---|---|---|---|---|---|
| Example 8 | Formulation Example 40 | Polyester polyol | 3-methylpentanediol | 0.90 | 1.28 | 0.76 | 0.69 | 1.02 | 0.3 |
| Example 9 | Formulation Example 41 | Polyester polyol | 3-methylpentanediol | 0.43 | 1.20 | 0.53 | 0.69 | 0.90 | 0.9 |
| Example 10 | Formulation Example 42 | Polyester polyol | 3-methylpentanediol | 0.58 | 1.20 | 0.65 | 0.72 | 1.10 | 0.6 |
| Example 11 | Formulation Example 43 | Polyester polyol | 3-methylpentanediol | 0.93 | 1.20 | 0.70 | 0.71 | 1.00 | 0.6 |
| Example 12 | Formulation Example 44 | Polyester polyol | 3-methylpentanediol | 0.49 | 0.99 | 0.55 | 0.70 | 0.98 | 0.6 |
| Example 13 | Formulation Example 45 | Polyester polyol | 3-methylpentanediol | 0.60 | 1.00 | 0.70 | 0.71 | 0.99 | 0.6 |
| Example 14 | Formulation Example 46 | Polyester polyol | 3-methylpentanediol | 1.08 | 1.18 | 0.79 | 0.99 | 1.10 | 0.6 |
| Example 15 | Formulation Example 47 | Polyester polyol | 3-methylpentanediol | 1.10 | 1.15 | 0.77 | 0.88 | 1.14 | 0.6 |
| Example 16 | Formulation Example 48 | Polyester polyol | 3-methylpentanediol | 0.98 | 1.05 | 0.76 | 0.85 | 1.18 | 0.3 |
| Example 17 | Formulation Example 49 | Polyester polyol | 3-methylpentanediol | 1.05 | 1.21 | 0.78 | 0.80 | 1.20 | 0.6 |
| Example 18 | Formulation Example 50 | Polyester polyol | 3-methylpentanediol | 1.04 | 1.20 | 0.69 | 0.84 | 1.22 | 0.9 |
| Example 19 | Formulation Example 51 | Polyester polyol | Diethylene glycol | 1.02 | 1.22 | 0.81 | 0.99 | 2.30 | 1.0 |
| Example 20 | Formulation Example 52 | Polyester polyol | 3-methylpentanediol | — | — | — | — | 1.19 | 1.5< |
| Example 21 | Formulation Example 53 | Polyester polyol | 3-methylpentanediol | — | — | — | — | 1.22 | 1.3 |
| Comparative Example 3 | Formulation Example 54 | Polyoxypropylene glycol | — | 13.00 | 21.00 | — | — | — | 1.0 |
| Comparative Example 4 | Formulation Example 55 | 1,4-poybutadiene polyol | — | 21.00 | 38.00 | — | — | — | 1.5< |
| Example 22 | Formulation Example 56 | Polyester polyol | 3-methylpentanediol | — | — | — | — | — | — |

TABLE 7-continued

| | Formulation to be used | Polyurethane to be used: Polyol | Polyurethane to be used: (Glycol component) | Carrier resistance (volumetric variation: %) IsoparM 23° C. | IsoparM 40° C. | SH-200 23° C. | SH-200 40° C. | Rate of volumetric variation (%) | Compression set (%) |
|---|---|---|---|---|---|---|---|---|---|
| Example 23 | Formulation Example 57 | Polyester polyol | 3-methylpentanediol | — | — | — | — | — | — |
| Example 24 | Formulation Example 58 | Polyester polyol | 3-methylpentanediol | — | — | — | — | — | — |
| Example 25 | Formulation Example 59 | Polyester polyol | 3-methylpentanediol | — | — | — | — | — | — |

*"—" in Table indicates that no measurement was made.

It is also found from the aforesaid Table 7 that the polyurethane obtained by reacting a polyester polyol with a difunctional isocyanate is resistant to volumetric variation in a material used as the carrier.

It is also found that in the case of using 3-methylpentanediol as the difunctional glycol of this polyester polyol (Examples 8 to 18, 20, and 21), the volumetric variation with environmental change is more highly suppressed than in the case of using, for example, diethylene glycol (Example 19).

Here, in the case of the rollers of Examples 22 and 24 provided with the elastic material layer having a JIS-A hardness less than 30, it was difficult to adjust the smoothness of the surface of the elastic material layer by the foregoing surface abrasion.

Furthermore, in the case of the rollers of Examples 23 and 25 provided with the elastic material layer having a JIS-A hardness exceeding 60, the elastic material layer was too hard and had the state unsuitable slightly for use in the developing roller of the liquid developing electrophotographic device.

Also, in Example using a polyol of which the average number of functional groups was 3.0 or more, it was confirmed that the compression set was less than 1%.

(Studies of an Abrasive Roller)

Example 26

Using a polyurethane having the formulation shown in Table 8, an elastic material layer of about 3 mm in thickness was provided around a core bar having a diameter of 10 mm and the surface of the elastic material layer was abraded such that the outside diameter of the elastic material layer was about 16 mm to manufacture an abrasive roller of Example 26.

More specifically, cerium oxide was mixed and dispersed in a polyester polyol, and the mixture was subjected to dewatering treatment and was heated to 100° C. TDI (tolylene diisocyanate) was added to the mixture, which was then stirred to be a uniformly mixed state and injected into a 150° C. metal mold with a core bar set thereto to react the mixture for one hour, thereby providing an elastic material layer on the outer periphery of the core bar. After reacting at 150° C. for 1 Hr, the article was released from the mold, followed by further crosslinking at 140° C. for 2 Hr to manufacture a pre-molded article.

This pre-molded article was surface-abraded by a cylindrical grinder into a given dimension to manufacture an abrasive roller of Example 26.

Examples 27 and 28 and Comparative Examples 5 and 6

Abrasive rollers of Example 27 and Comparative Examples 5 and 6 were manufactured in the same manner as in Example 26 except that the formulation of the polyurethane was altered as shown in Table 8.

Also, as Example 28, an abrasive roller provided with an elastic material layer constituted only of polyurethane without formulating cerium oxide was manufactured.

TABLE 8

| | Formulation | Hardness |
|---|---|---|
| Example 26 | Polyester polyol "Nipporan 4032", 95 parts by weight + TDI 9.5 parts by weight + cerium oxide 5 parts by weight | 62 |
| Example 27 | Polyester polyol "Nipporan 4032" 97.7 parts by weight + TDI 9.8 parts by weight + cerium oxide 0.3 parts by weight | 60 |
| Example 28 | Polyester polyol "Nipporan 4032" 100 parts by weight + TDI 10 parts by weight (no cerium oxide is added) | 59 |
| Comparative Example 5 | Polyether polyol (PPG) 95 parts by weight + TDI 9.5 parts by weight + cerium oxide 5 parts by weight | 61 |
| Comparative Example 6 | Liquid polybutadiene (polybutadiene polyol) 95 parts by weight + TDI 9.5 parts by weight + cerium oxide 5 parts by weight | 61 |

(Evaluation 1 of Carrier Resistance)

(Carrier Immersing Test of Polyurethane Elastic Material Sample)

A polyurethane elastic material sample of 30 mm (width)×30 mm (length)×2 mm (thickness) was manufactured according to the formulation described in Table 8.

The manufactured polyurethane elastic material was immersed in a hydrocarbon based carrier (trade name: "IsoparM", manufactured by Exxon Mobil Corporation) containing isoparaffin as its major component for a total of 7 days to measure a variation in the volume of each sample with the passage of immersing days.

At this time, as the temperature of "IsoparM" to be immersed, two temperatures 23° C. and 40° C. were adopted to make tests, wherein as to the rate of volumetric variation, the width and length were measured using a calipers and thickness was measured according to the method described in JIS K 6253 with expressing an increase in volume from the initial volume by percentages.

The results are shown in Table 9.

TABLE 9

| | | Immersing days (days) 0.5 | 1 | 2 | 3 | 5 | 7 |
|---|---|---|---|---|---|---|---|
| Example 26 | 23° C. | 0.0 | 0.2 | 0.5 | 0.6 | 0.7 | 0.7 |
| | 40° C. | 0.1 | 0.3 | 0.6 | 0.8 | 0.8 | 0.8 |

TABLE 9-continued

| | | Immersing days (days) | | | | | |
|---|---|---|---|---|---|---|---|
| | | 0.5 | 1 | 2 | 3 | 5 | 7 |
| Example 27 | 23° C. | 0.0 | 0.1 | 0.5 | 0.6 | 0.7 | 0.7 |
| | 40° C. | 0.1 | 0.3 | 0.7 | 0.8 | 0.8 | 0.8 |
| Example 28 | 23° C. | 0.0 | 0.2 | 0.4 | 0.5 | 0.7 | 0.7 |
| | 40° C. | 0.1 | 0.3 | 0.6 | 0.7 | 0.8 | 0.8 |
| Comparative | 23° C. | 4.7 | 7.5 | 9.8 | 11.2 | 11.9 | 12.6 |
| Example 5 | 40° C. | 6.5 | 9.1 | 13.3 | 17.6 | 20.9 | 22.4 |
| Comparative | 23° C. | 6.0 | 11.6 | 14.0 | 16.2 | 17.5 | 18.6 |
| Example 6 | 40° C. | 8.5 | 12.2 | 18.6 | 23.4 | 25.1 | 26.0 |

(Evaluation 2 of Carrier Resistance)

(Roller Rotation Test by Immersing in a Carrier)

Each abrasive roller of Examples and Comparative Examples was subjected to a carrier resistance test in which it was supported horizontally to put the roller in such a state that the lower half thereof was immersed in a liquid toner (about 30° C.) using isoparaffin as the carrier to rotate the roller at a rotating rate of about 40 rpm while using a blade to scrape a liquid film of the liquid toner formed on the surface of the roller along with the rotation.

The hardness (JIS-A hardness) and variation in outside diameter of the abrasive roller at this time were measured.

Specifically, with regard to the abrasive rollers of Examples 26 to 28, the values in the initial state and the values 7 days after the carrier resistance test were measured.

With regard to the abrasive roller of Comparative Examples 5 and 6, each of these rollers was largely swollen (volumetric change was large) and therefore, the variation in outside diameter could not be measured. Also, as to the hardness, the values 4 days after the carrier resistance test was measured in the case of the abrasive roller of Comparative Example 5 and the values 2 days after the carrier resistance test was measured in the case of the abrasive roller of Comparative Example 6.

The results are shown in Table 10.

Furthermore, the surface of the photoreceptor which was abraded by the abrasive roller was allowed to charge by using a corotron charger.

Here, the photoreceptor and the abrasive roller were driven using a motor and a gear and the rotation of the photoreceptor was at 60 rpm and the rotation of the abrasive roller was at 40 rpm.

Also, as to the abrasive roller, a load of 750 gf was applied toward the abrasive roller side at each end part of the shaft so that the nip width of the abrasive roller was about 1.2 mm.

Also, a voltage of 3 kV was applied to the corotron charger to charge.

The photoreceptor was abraded for 12 hours to measure a variation in the film thickness of the charge transfer layer of the photoreceptor before and after the abrasion by a film thickness measuring system (trade name: "MPCD-3000", manufactured by Otsuka Electronics Co., Ltd.).

Furthermore, a toner cartridge (trade name: "HP Laser Jet 3500", manufactured Hewlett Packard) was set to the photoreceptor after the photoreceptor was abraded to evaluate an image.

The evaluation of an image was made by visually observing an image printed with a random pattern of 5% density/sheet English characters.

As a result, in the case of the roller of Example 28, the photoreceptor was not abraded and the so-called "image blurring" (phenomenon that the resolution is deteriorated so that the outline of a character is blurred) was observed.

In the case of the abrasive roller of Example 26, on the other hand, the photoreceptor was abraded by 1.3 μm and a deterioration of the image was not observed.

In the case of the abrasive roller of Example 27, the photoreceptor was not abraded. It was found that unless the number of rotations of the abrasive roller was increased or the load was increased to increase the nip width, it is difficult to suppress a deterioration in the performance of the photoreceptor unlike the abrasive roller of Example 26.

TABLE 10

| | | Example 26 | Example 27 | Example 28 | Comparative Example 5 | Comparative Example 6 |
|---|---|---|---|---|---|---|
| Variation in hardness (degree) | Initial stage | 62 | 60 | 59 | 61 | 61 |
| | After a carrier resistance test | 62 | 60 | 59 | 58 | 57 |
| Outside diameter of the roller(mm) | Initial stage | 16.02 | 16.01 | 16.01 | 16.00 | 16.03 |
| | After a carrier resistance test | 16.02 | 16.01 | 16.01 | Non-measurable | Non-measurable |

*With regard to the column "After a carrier resistance test", the data was obtained as follows: the data of Examples 26 to 28 was obtained 7 days after the carrier resistance test, the data of Comparative Example 5 was obtained 4 days after the carrier resistance test, and the data of Comparative Example 6 was obtained 2 days after the carrier resistance test.

(Evaluation of Abrasive Performance of Photoreceptor)

Figure 3:
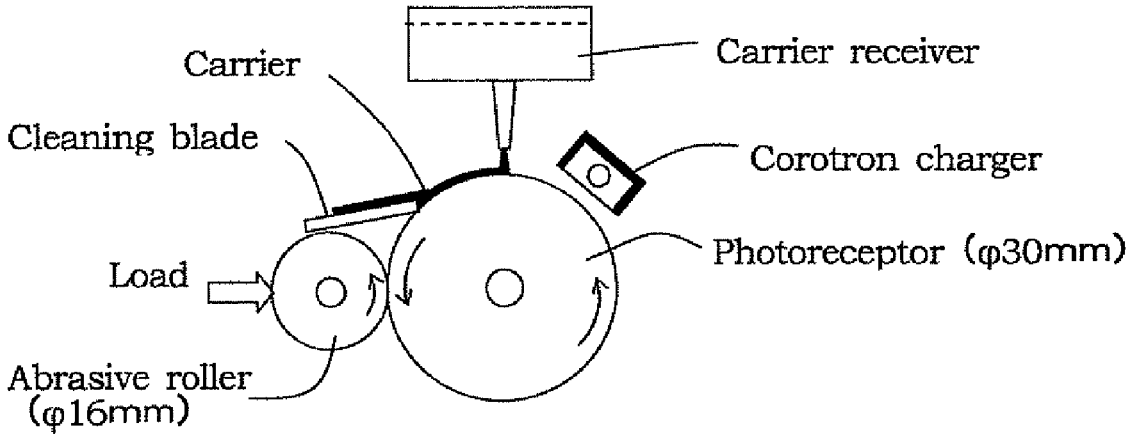
FIG. 3 is a schematic side view showing a test method of evaluation of the abrasive performance of a photoreceptor.

As shown in FIG. 3, the photoreceptor (φ30 mm) was abraded by an abrasive roller (φ16 mm).

In the abrasion of this photoreceptor, the carrier of a liquid developer was dropped on the surface of the photoreceptor and then removed by the cleaning blade. Then, the abrasive roller is brought into contact with the photoreceptor after the photosensitive roller was cleaned by this cleaning blade and furthermore, the abrasive roller was rotated in the same direction as the photoreceptor, to thereby allow the outer peripheral surfaces of the photoreceptor and the abrasive roller to move in the directions opposite to each other thereby abrading the surface of the photoreceptor.

It is also understood from the aforesaid results that the roller in which the abrasive agent is contained in the elastic material layer can be preferably used as an abrasive roller. It is furthermore understood that the abrasive agent is preferably formulated in an amount of 0.5% by weight or more.

(Studies of a Surface Layer)

Example 29

A polyurethane elastic material using a polyester polyol was provided around a core bar and the surface of the elastic material was abraded into a prescribed dimension to form a base material layer.

Then, a thermoplastic polyurethane solution having the formulation shown in Table 11 was prepared and applied to the surface of the aforesaid base material layer by dip coating and the base material layer was heat-treated at 130° C.×2 Hr to react the thermoplastic polyurethane with a fluorine based resin of the fluorine modifier to form a surface layer, thereby manufacturing a liquid developing electrophotographic device roller (diameter: 30 mm) of Example 29.

Examples 30 to 43

Liquid developing electrophotographic device rollers were manufactured in the same manner as in Example 29 except that the formulation of the surface layer was that shown in Table 11.

allowed to stand for 20 seconds and then the contact angle of the droplet was measured. These operations were repeated to measure the contact angle ten times in total including the first time and an average of 10 measured data was defined as the advance contact angle (θa).

2.0 μL of the carrier was sucked from the liquid droplet of the carrier after this advance contact angle (θa) was measured, then allowed to stand for 20 seconds and then the contact angle of the liquid droplet was measured by a contact angle meter. These operations were repeated to measure the contact angle nine times and an average of 9 measured data was defined as the retreat contact angle (θr).

TABLE 11

| | Formulation (unit: parts by weight) | | | | | | | | | |
|---|---|---|---|---|---|---|---|---|---|---|
| | TPU*[1] | Modifier 1*[2] | Modifier 2*[3] | Modifier 3*[4] | Modifier 4*[5] | Modifier 5*[6] | Crosslinking agent*[7] | Catalyst*[8] | CB*[9] | Solvent |
| Example 29 | 100 | 3.5 | — | — | — | — | — | — | 40 | THF |
| Example 30 | 100 | 3.5 | — | — | — | — | 10 | 1.0 | 40 | (tetrahydro |
| Example 31 | 100 | — | 1.0 | — | — | — | — | — | 40 | furan) was |
| Example 32 | 100 | — | 1.0 | — | — | — | 10 | 1.0 | 40 | added such |
| Example 33 | 100 | — | 1.2 | — | — | — | — | — | 40 | that the |
| Example 34 | 100 | — | 1.2 | — | — | — | 10 | 1.0 | 40 | solid |
| Example 35 | 100 | — | 0.8 | — | — | — | — | — | 40 | concentration |
| Example 36 | 100 | — | 0.8 | — | — | — | 10 | 1.0 | 40 | was |
| Example 37 | 100 | — | — | 0.1 | — | — | — | — | 40 | 10% by |
| Example 38 | 100 | — | — | 0.1 | — | — | 10 | 1.0 | 40 | weight |
| Example 39 | 100 | — | — | 0.08 | — | — | — | — | 40 | |
| Example 40 | 100 | — | — | 0.08 | — | — | 10 | 1.0 | 40 | |
| Example 41 | 100 | — | — | — | 0.1 | — | — | — | 40 | |
| Example 42 | 100 | — | — | — | 0.1 | — | 10 | 1.0 | 40 | |
| Example 43 | 100 | — | — | — | — | 25 | — | — | 40 | |

*[1]Ether based thermoplastic polyurethane

*[2]Fluorine modifier using a fluorine based resin in which a perfluoroalkyl structure is block-copolymerized and contains a plurality of reactive functional groups in its molecule (trade name: "FF121DN", manufactured by Dainichiseika Color & Chemicals Mfg. Co., Ltd.)

*[3]Fluorine modifier using a fluorine based resin in which a perfluoroalkyl structure is block-copolymerized and contains a difunctional reactive functional group in its molecule (trade name: "FLUORLINK E10H", manufactured by Solveisorexes)

*[4]Fluorine modifier using a fluorine based resin in which a perfluoroalkyl structure is block-copolymerized and contains a monofunctional reactive functional group in its molecule (trade name: "FTX-212D", manufactured by NEOS)

*[5]Fluorine modifier using a fluorine based resin in which a perfluoroalkyl structure is grafted (trade name: "Megafac F-482", manufactured by Dainippon Ink and Chemicals, Incorporated)

*[6]Silicone based modifier using a silicone resin (trade name: "GS-30", manufactured by Toagosei Co., Ltd.)

*[7]Isocyanate based crosslinking agent (trade name: "TPA-B80X", manufactured by Asahi Chemical Industry Co., Ltd., material name: block body of hexamethylene-diisocyanate modifier)

*[8]Catalyst (trade name: Neostan U-100", manufactured by Nitto Kasei Co., Ltd., material name: dibutyltin laurate)

*[9]Carbon black (trade name: "KETCHEN BLACK EC300J", manufactured by Ketchen Black International Company)

(Measurement of Contact Angle)

(Initial Contact Angle: Measurement of Dynamic Contact Angle)

A hydrocarbon based carrier (trade name: "IsoparM", manufactured by Exxon Mobil Corporation) containing isoparaffin as its major component was dropped slowly on the surface of the liquid developing electrophotographic device roller of each example to measure contact angle and then, the carrier was further dropped on the dropped carrier. With increasing the size of the liquid droplet formed on the surface of the liquid developing electrophotographic device roller, the contact angle of the droplet was measured, to determine the advance contact angle (θa). Then, with sucking the liquid droplet, the contact angle of the liquid droplet was measured, to determine the retreat contact angle (θr).

More specifically, 2.0 μL of the carrier was slowly dropped on the surface of the liquid developing electrophotographic device roller and allowed to stand for 20 seconds, and then the contact angle of the droplet was measured by using a contact angle meter. Then, 2.0 μL of the carrier was further dropped on the place where the carrier was previously dropped and Here, this dynamic contact angle was measured in the condition that the temperatures of the carrier and the liquid developing electrophotographic device roller were both set to normal temperature (23±3° C.). The results are shown in Table 12.

(Variation in Contact Angle Caused by Carrier)

2.0 μL of a hydrocarbon based carrier (trade name: "IsoparM", manufactured by Exxon Mobil Corporation) containing isoparaffin as its major component was dropped slowly on the surface of the liquid developing electrophotographic device roller of each example and allowed to stand for 20 seconds, and then, the contact angle of the liquid droplet was measured as the initial contact angle (θ1).

Then, the liquid developing electrophotographic device roller of each example was immersed in the aforesaid carrier for 12 hours and the carrier was wiped. Then, the contact angle was measured in the same manner as in the case of measuring the initial contact angle as the post-carrier immersing contact angle (θ2).

A difference (θ1-θ2) between the initial contact angle (θ1) and the post-carrier immersing contact angle (θ2) was defined as a contact angle variation (Δθ).

The initial contact angle (θ1), the post-carrier immersing contact angle (θ2) and contact angle variation (Δθ) of each example are shown in Table 12.

TABLE 12

| | Measurement of dynamic contact angle | | Variation in contact angle caused by carrier | | |
|---|---|---|---|---|---|
| | | | | Post-carrier | |
| | Advance contact angle (θa: deg) | Retreat contact angle (θr: deg) | Initial contact angle (θ1: deg) | immersing contact angle (θ2: deg) | Contact angle variation (Δθ: deg) |
| Example 29 | 75 | 49 | 74 | 55 | 19 |
| Example 30 | 84 | 68 | 81 | 69 | 12 |
| Example 31 | 62 | 41 | 63 | 41 | 22 |
| Example 32 | 66 | 48 | 67 | 49 | 18 |
| Example 33 | 63 | 42 | 64 | 44 | 20 |
| Example 34 | 66 | 49 | 65 | 47 | 18 |
| Example 35 | 48 | 30 | 47 | 29 | 18 |
| Example 36 | 52 | 36 | 52 | 36 | 16 |
| Example 37 | 46 | 24 | 46 | 23 | 23 |
| Example 38 | 46 | 24 | 46 | 24 | 22 |
| Example 39 | 33 | 20 | 35 | 22 | 13 |
| Example 40 | 34 | 19 | 37 | 20 | 17 |
| Example 41 | 89 | 16 | 86 | 14 | 72 |
| Example 42 | 87 | 19 | 86 | 15 | 71 |
| Example 43 | 21 | 4 | 20 | 2 | 19 |

It is also found from Table 12 that in the case of using a fluorine based resin in which perfluoroalkyl is block-copolymerized, a variation in contact angle caused by the carrier before and after the roller is brought into contact with the carrier is more highly suppressed than in the case (Examples 41 and 42) of using a fluorine based resin in which perfluoroalkyl is grafted.

It is also found that as the fluorine based resin in which perfluoroalkyl is block-copolymerized, a fluorine based resin having a polyfunctional group (Examples 29 to 36) suppresses a variation in contact angle when used together with a crosslinking agent.

Examples 44 and 60

Liquid developing photographic device rollers were produced in the same manner as in Example 29 except that the surface layer was formed using resin compositions having the formulations shown in Table 13.

Here, in Table 13, the amount of a fluorine based resin filler to be formulated shows a solid content (based on polytetrafluoroethylene resin particle) parts by weight or % by volume.

TABLE 13

| | Formulation (unit: parts by weight) | | | | | | | | | |
|---|---|---|---|---|---|---|---|---|---|---|
| | | | | | | | | Filler*10 | | |
| | TPU*1 | Modifier 1*2 | Modifier 2*3 | Modifier 4*5 | Crosslinking agent*7 | Catalyst*8 | CB*9 | Parts by weight | Vol % | Solvent |
| Example 30 | 100 | 3.5 | — | — | 10 | 1 | 40 | 0 | 0 | THF |
| Example 44 | 100 | 3.5 | — | — | 10 | 1 | 40 | 1 | 0.5 | (tetrahydro- |
| Example 45 | 100 | 3.5 | — | — | 10 | 1 | 40 | 5 | 2.5 | furan) was |
| Example 46 | 100 | 3.5 | — | — | 10 | 1 | 40 | 10 | 4.9 | added such |
| Example 47 | 100 | 3.5 | — | — | 10 | 1 | 40 | 20 | 9.3 | that the solid |
| Example 48 | 100 | 3.5 | — | — | 10 | 1 | 40 | 30 | 13.4 | concentration |
| Example 49 | 100 | 3.5 | — | — | 10 | 1 | 40 | 40 | 17.0 | was 10% by |
| Example 32 | 100 | — | 1 | — | 10 | 1 | 40 | 0 | 0 | weight |
| Example 50 | 100 | — | 1 | — | 10 | 1 | 40 | 1 | 0.5 | |
| Example 51 | 100 | — | 1 | — | 10 | 1 | 40 | 5 | 2.5 | |
| Example 52 | 100 | — | 1 | — | 10 | 1 | 40 | 30 | 13.4 | |
| Example 53 | 100 | — | 1 | — | 10 | 1 | 40 | 40 | 17.0 | |
| Example 54 | 100 | — | 1 | — | 10 | 1 | 40 | 50 | 20.4 | |
| Example 42 | 100 | — | — | 0.1 | 10 | 1 | 40 | 0 | 0 | |
| Example 55 | 100 | — | — | 0.1 | 10 | 1 | 40 | 1 | 0.5 | |
| Example 56 | 100 | — | — | 0.1 | 10 | 1 | 40 | 40 | 17.0 | |
| Example 57 | 100 | — | — | — | — | — | 40 | 5 | 2.5 | |
| Example 58 | 100 | — | — | — | — | — | 40 | 10 | 4.9 | |

TABLE 13-continued

| | Formulation (unit: parts by weight) | | | | | | | | | |
|---|---|---|---|---|---|---|---|---|---|---|
| | | | | | | | | Filler*10 | | |
| | TPU*1 | Modifier 1*2 | Modifier 2*3 | Modifier 4*5 | Crosslinking agent*7 | Catalyst*8 | CB*9 | Parts by weight | Vol % | Solvent |
| Exanrple 59 | 100 | — | — | — | — | — | 40 | 20 | 9.3 | |
| Example 60 | 100 | — | — | — | — | — | 40 | 30 | 13.4 | |

*1Ether based thermoplastic polyurethane

*2Fluorine modifier using a fluorine based resin in which a perfluoroalkyl structure is block-copolymerized and contains a plurality of reactive functional groups in its molecule (trade name: "FF121DN", manufactured by Dainichiseika Color & Chemicals Mfg. Co., Ltd.)

*3Fluorine modifier using a fluorine based resin in which a perfluoroalkyl structure is block-copolymerized and contains a difunctional reactive functional group in its molecule (trade name: "FLUORLINK E10H", manufactured by Solveisorexes Company)

*5Fluorine modifier using a fluorine based resin in which a perfluoroalkyl structure is grafted (trade name: "Megafac F-482", manufactured by Dainippon Ink and Chemicals, Incorporated)

*7Isocyanate based crosslinking agent (trade name: "TPA-B80X", manufactured by Asahi Chemical Industry Co., Ltd., material name: block body of hexamethylene-diisocyanate modifier)

*8Catalyst (trade name: Neostan U-100", manufactured by Nitto Kasei Co., Ltd., material name: dibutyltin laurate)

*9Carbon black (trade name: "KETCHEN BLACK EC300J", manufactured by Ketchen Black International Company)

*10Fluorine based resin filler (trade name: "KD600AS", manufactured by Kitamura Limited, material name: a dispersion solution of polytetrafluoroethylene resin particles having an average particle diameter of 0.3 μm)

Example 61

A liquid developing electrophotographic device roller was manufactured in the same manner as in Example 45 except that as the fluorine based resin filler (fluorine based resin particles) dispersed in the surface layer, a fluorine based resin filler (trade name: "KTL-2N", manufactured by Kitamura Limited, a dispersion solution of polytetrafluoroethylene resin particles having an average particle diameter of 3.0 μm) was used in place of the fluorine based resin filler (trade name: "KD600AS", manufactured by Kitamura Limited, a dispersion solution of polytetrafluoroethylene resin particles having an average particle diameter of 0.3 μm).

Example 62

A liquid developing electrophotographic device roller was manufactured in the same manner as in Example 45 except that as the fluorine based resin filer fluorine based resin particles) dispersed in the surface layer, a fluorine based resin filer (trade name: "KTL-8N", manufactured by Kitamura Limited, a dispersion solution of polytetrafluoroethylene resin particles having an average particle diameter of 4.3 μm) was used in place of the fluorine based resin filler (trade name: "KD600AS", manufactured by Kitamura Limited, a dispersion solution of polytetrafluoroethylene resin particles having an average particle diameter of 0.3 μm).

(Measurement of Contact Angle)

(Initial Contact Angle: Measurement of Dynamic Contact Angle)

A hydrocarbon based carrier (trade name: "IsoparM", manufactured by Exxon Mobil Corporation) containing isoparaffin as its major component was dropped slowly on the surface of the liquid developing electrophotographic device roller of each example to measure contact angle and then, a carrier was further dropped on the dropped carrier. With increasing the size of the liquid droplet formed on the surface of the liquid developing electrophotographic device roller, the contact angle of the droplet was measured, to determine the advance contact angle (θa). Then, with sucking the liquid droplet, the contact angle of the liquid droplet was measured, to determine the retreat contact angle (θr).

More specifically, 2.0 μL of the carrier was slowly dropped on the surface of the liquid developing electrophotographic device roller and allowed to stand for 20 seconds, and then the contact angle of the droplet was measured by using a contact angle meter. Then, 2.0 μL of the carrier was further dropped on the place where the carrier was previously dropped and allowed to stand for 20 seconds and then the contact angle of the droplet was measured. These operations were repeated to measure the contact angle ten times in total including the first time and an average of 10 measured data was defined as the advance contact angle (θa).

2.0 μL of the carrier was sucked from the liquid droplet of the carrier after this advance contact angle (θa) was measured, then allowed to stand for 20 seconds and then the contact angle of the liquid droplet was measured. These operations were repeated to measure the contact angle nine times and an average of 9 measured data was defined as the retreat contact angle (θr).

Here, this dynamic contact angle was measured in the condition that the temperatures of the carrier and the liquid developing electrophotographic device roller were both set to normal temperature (23±3° C.) The measured advance contact angle (θa), retreat contact angle (θr) and difference (θa-θr) between the advance contact angle and the retreat contact angle are shown in Table 14.

(Variation in Contact Angle Caused by Carrier)

2.0 μL of a hydrocarbon based carrier (trade name: "IsoparM", manufactured by Exxon Mobil Corporation) containing isoparaffin as its major component was dropped slowly on the surface of the liquid developing electrophotographic device roller of each example and allowed to stand for 20 seconds, and then, the contact angle of the liquid droplet was measured as the initial contact angle (θ1).

Then, the liquid developing electrophotographic device roller of each example was dropped in the aforesaid carrier for 12 hours and the carrier was wiped. Then, the contact angle was measured in the same manner as in the case of measuring the initial contact angle as the post-carrier immersing contact angle (θ2).

A difference (θ1-θ2) between the initial contact angle (θ1) and the post-carrier immersing contact angle (θ2) was defined as a contact angle variation (Δθ).

The initial contact angle (θ1), the post-carrier immersing contact angle (θ2) and the contact angle variation (Δθ) of each example are shown in Table 14.

TABLE 14

| | Advance contact angle (θa: deg) | Retreat contact angle (θr: deg) | Difference (θa − θr) | Initial contact angle (θ1: deg) | Post-carrier immersing contact angle (θ2: deg) | Contact angle variation (Δθ: deg) |
|---|---|---|---|---|---|---|
| Example 30 | 84 | 68 | 16 | 81 | 69 | 12 |
| Example 44 | 85 | 69 | 16 | 83 | 69 | 14 |
| Example 45 | 87 | 86 | 1 | 88 | 86 | 2 |
| Example 46 | 90 | 87 | 3 | 89 | 87 | 2 |
| Example 47 | 89 | 85 | 4 | 89 | 86 | 3 |
| Example 48 | 89 | 85 | 4 | 89 | 86 | 3 |
| Example 49 | 88 | 83 | 5 | 90 | 86 | 4 |
| Example 32 | 66 | 48 | 18 | 67 | 49 | 18 |
| Example 50 | 67 | 48 | 19 | 66 | 47 | 19 |
| Example 51 | 67 | 53 | 14 | 66 | 51 | 15 |
| Example 52 | 69 | 55 | 14 | 68 | 53 | 15 |
| Example 53 | 68 | 58 | 10 | 66 | 57 | 9 |
| Example 54 | 69 | 58 | 11 | 69 | 59 | 10 |
| Example 61 | 85 | 73 | 12 | 88 | 75 | 13 |
| Example 62 | 86 | 50 | 36 | 87 | 52 | 35 |
| Example 42 | 87 | 19 | 68 | 86 | 15 | 71 |
| Example 55 | 86 | 18 | 68 | 85 | 16 | 69 |
| Example 56 | 89 | 25 | 64 | 90 | 23 | 67 |
| Example 57 | 80 | 15 | 65 | 82 | 17 | 65 |
| Example 58 | 84 | 11 | 73 | 85 | 15 | 70 |
| Example 59 | 87 | 14 | 73 | 85 | 16 | 69 |
| Example 60 | 86 | 15 | 71 | 86 | 15 | 71 |

It is found from Table 14 that Examples 45 to 49 are more highly reduced in the difference between the advance contact angle and the retreat contact angle than those of Examples 30 and 44.

It is also found that Examples 51 to 54 are more highly reduced in the difference between the advance contact angle and the retreat contact angle than those of Examples 32 and 50.

Specifically, it is understood that the liquid developing electrophotographic device can be made to have a stable printing performance free from a variation in printing performance when it is operated, by dispersing fluorine based resin particles in an amount of 2.5 to 20.4% by volume in the surface layer.

Furthermore, it is found that Examples 45 and 61 are more highly reduced in the difference between the advance contact angle and the retreat contact angle than that of Example 62.

Specifically, it is understood that the liquid developing electrophotographic device can be made to have a stable printing performance free from a variation in printing performance when it is operated, by making fluorine based resin particles have an average particle diameter of 0.3 to 3.0 μm.

The invention claimed is:

1. A liquid developing electrophotographic device roller comprising a shaft and an elastic material layer provided around the outer peripheral side of the shaft, wherein said elastic material layer is formed by using a polyurethane obtained by reacting a polyester polyol with a difunctional isocyanate, the polyester polyol being obtained by reacting adipic acid with a difunctional glycol and trimethylolpropane, the difunctional glycol being selected from the group consisting of diethylene glycol, 1,4-butanediol and 3-methylpentanediol.

2. The liquid developing electrophotographic device roller according to claim 1, wherein said elastic material layer is formed such that the layer has a JIS-A hardness of 30 to 60 degrees.

3. The liquid developing electrophotographic device roller according to claim 1, wherein as said difunctional isocyanate, any of tolylenediisocyanate and xylenediisocyanate is used.

4. The liquid developing electrophotographic device roller according to claim 1, wherein said difunctional glycol is 3-methylpentanediol.

5. The liquid developing electrophotographic device roller according to claim 1, wherein carbon black is dispersed in said polyurethane to make said elastic material layer have a volume resistance of $10^2$ to $10^6$ Ω·cm.

6. The liquid developing electrophotographic device roller according to claim 1, which is formed such that the roller has a surface roughness of 3 μm or less in terms of ten point height of roughness profile (Rz) prescribed in JIS B 0601.

7. The liquid developing electrophotographic device roller according to claim 1, wherein the roller includes a base material layer containing said elastic material layer and a surface layer which is to be brought into contact with a liquid developer on the base material layer, and wherein said surface layer is formed of a resin composition obtained by reacting a fluorine based resin having a structure, in which a part of a block copolymer containing a perfluoroalkyl block and other blocks is substituted with a reactive functional group, with a base resin.

8. The liquid developing electrophotographic device roller according to claim 7, wherein the base resin of said surface layer is a thermoplastic polyurethane.

9. The liquid developing electrophotographic device roller according to claim 7, wherein said reactive functional group is a polyfunctional reactive functional group.

10. The liquid developing electrophotographic device roller according to claim 9, wherein said surface layer is formed by crosslinking said thermoplastic polyurethane in the presence of said fluorine based resin by using a crosslinking agent.

11. The liquid developing electrophotographic device roller according to claim 10, wherein said crosslinking agent is an isocyanate based crosslinking agent.

12. The liquid developing electrophotographic device roller according to claim 9, wherein fluorine based resin particles having an average particle diameter of 0.3 to 3.0 μm are dispersed in said surface layer and said fluorine based resin particles are dispersed in a proportion of 2.5 to 20.4% by volume in said surface layer.

13. The liquid developing electrophotographic device roller according to claim 12, wherein said fluorine based resin particles are polytetrafluoroethylene resin particles.

14. The liquid developing electrophotographic device roller according to claim 1, which is used for abrading the surface of a photoreceptor of the liquid developing electrophotographic device, wherein said elastic material layer is disposed on the outermost peripheral side which is brought into contact with said photoreceptor and said elastic material layer is provided with an abrasive agent dispersed therein.

15. The liquid developing electrophotographic device roller according to claim 14, wherein said abrasive agent is a cerium oxide powder.

16. The liquid developing electrophotographic device roller according to claim 14, wherein the abrasive agent is dispersed in a ratio of 0.5 to 30% by weight in said elastic material layer to form the elastic material layer having a JIS-A hardness of 40 to 70 degrees.

17. A liquid developing electrophotographic device using a liquid developer produced by dispersing a toner in a carrier and provided with a liquid developing electrophotographic device roller comprising a shaft and an elastic material layer provided around the outer peripheral side of the shaft, wherein said elastic material layer is formed by using a polyurethane obtained by reacting a polyester polyol with a difunctional isocyanate.

18. The liquid developing electrophotographic device according to claim 17, wherein said elastic material layer is formed by using a polyurethane obtained by reacting a difunctional isocyanate with a polyester polyol having a sp value larger by 2 or more than the sp value of said carrier.

19. The liquid developing electrophotographic device according to claim 17, wherein the sp value of said carrier is 8 or less and the sp value of said polyester polyol is 10 or more.

* * * * *